US010221638B2

(12) United States Patent
Turley et al.

(10) Patent No.: US 10,221,638 B2
(45) Date of Patent: Mar. 5, 2019

(54) TELEMETRY OPERATED CEMENTING PLUG RELEASE SYSTEM

(71) Applicant: Weatherford Technology Holdings, LLC, Houston, TX (US)

(72) Inventors: Rocky A. Turley, Houston, TX (US); Robin L. Campbell, Webster, TX (US); Richard Lee Giroux, Cypress, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 129 days.

(21) Appl. No.: 15/357,732

(22) Filed: Nov. 21, 2016

(65) Prior Publication Data

US 2017/0067304 A1 Mar. 9, 2017

Related U.S. Application Data

(63) Continuation of application No. 14/083,021, filed on Nov. 18, 2013, now Pat. No. 9,523,258.

(51) Int. Cl.

| | |
|---|---|
| ***E21B 23/00*** | (2006.01) |
| ***E21B 33/16*** | (2006.01) |
| ***E21B 17/02*** | (2006.01) |
| ***E21B 33/13*** | (2006.01) |

(Continued)

(52) U.S. Cl.

CPC ..... *E21B 23/00* (2013.01); *E21B 17/028* (2013.01); *E21B 33/13* (2013.01); *E21B 33/134* (2013.01); *E21B 33/16* (2013.01); *E21B 47/12* (2013.01)

(58) Field of Classification Search

CPC ..... E21B 23/00; E21B 47/12; E21B 33/13; E21B 33/134; E21B 17/028; E21B 33/16

See application file for complete search history.

(56) References Cited

U.S. PATENT DOCUMENTS

| | | | |
|---|---|---|---|
| 2,693,859 | A | 11/1954 | Wright |
| 4,405,017 | A | 9/1983 | Allen et al. |
| 4,583,593 | A | 4/1986 | Zunkel et al. |

(Continued)

FOREIGN PATENT DOCUMENTS

| | | | | |
|---|---|---|---|---|
| GB | 2350141 | A | 11/2000 | |
| WO | 2012065123 | A2 | 5/2012 | |
| WO | WO-2012065126 | A2 * | 5/2012 | ..... E21B 23/06 |

OTHER PUBLICATIONS

Australian Examination Report dated Dec. 5, 2017, for Australian Patent Application No. 2016250376.

(Continued)

*Primary Examiner* — Brad Harcourt

(74) *Attorney, Agent, or Firm* — Patterson + Sheridan, LLP

(57) ABSTRACT

A plug release system for cementing a tubular string into a wellbore includes: a wiper plug; a tubular housing; a latch for releasably connecting the wiper plug to the housing. The latch includes: a fastener engageable with one of the wiper plug and the housing; a lock movable between a locked position and an unlocked position, the lock keeping the fastener engaged in the locked position; and an actuator connected to the lock and operable to at least move the lock from the locked position to the unlocked position. The plug release system further includes an electronics package disposed in the housing and in communication with the actuator for operating the actuator in response to receiving a command signal.

21 Claims, 10 Drawing Sheets

(51) Int. Cl.
*E21B 33/134* (2006.01)
*E21B 47/12* (2012.01)

(56) References Cited

U.S. PATENT DOCUMENTS

| | | | |
|---|---|---|---|
| 4,893,678 | A | 1/1990 | Stokley et al. |
| 5,086,843 | A | 2/1992 | Mims et al. |
| 5,086,844 | A | 2/1992 | Mims et al. |
| 5,146,992 | A | 9/1992 | Baugh |
| 5,170,847 | A | 12/1992 | Mims et al. |
| 5,174,375 | A | 12/1992 | Mims et al. |
| 5,360,069 | A | 11/1994 | Schmuck et al. |
| 5,435,390 | A | 7/1995 | Baugh et al. |
| 5,553,667 | A | 9/1996 | Budde et al. |
| 5,560,426 | A | 10/1996 | Trahan et al. |
| 5,590,713 | A | 1/1997 | Baugh et al. |
| 5,787,979 | A | 8/1998 | Giroux et al. |
| 5,813,457 | A | 9/1998 | Giroux et al. |
| 5,833,002 | A | 11/1998 | Holcombe |
| 5,856,790 | A | 1/1999 | Baugh et al. |
| 5,954,133 | A | 9/1999 | Ross |
| 6,009,944 | A | 1/2000 | Gudmestad |
| 6,053,244 | A | 4/2000 | Dybevik et al. |
| 6,056,053 | A | 5/2000 | Giroux et al. |
| 6,065,536 | A | 5/2000 | Gudmestad et al. |
| 6,241,018 | B1 | 6/2001 | Eriksen |
| 6,241,023 | B1 | 6/2001 | Krauss et al. |
| 6,244,350 | B1 | 6/2001 | Gudmestad et al. |
| 6,311,771 | B1 | 11/2001 | Gudmestad et al. |
| 6,318,472 | B1 | 11/2001 | Rogers et al. |
| 6,419,015 | B1 | 7/2002 | Budde et al. |
| 6,527,057 | B2 | 3/2003 | Fraser, III et al. |
| 6,536,524 | B1 | 3/2003 | Snider |
| 6,561,270 | B1 | 5/2003 | Budde |
| 6,597,175 | B1 | 7/2003 | Brisco |
| 6,634,428 | B2 | 10/2003 | Krauss et al. |
| 6,789,619 | B2 | 9/2004 | Carlson et al. |
| 6,799,638 | B2 | 10/2004 | Butterfield, Jr. |
| 6,848,511 | B1 | 2/2005 | Jones et al. |
| 6,866,100 | B2 | 3/2005 | Gudmestad et al. |
| 6,966,368 | B2 | 11/2005 | Farquhar |
| 7,063,148 | B2 | 6/2006 | Jabusch |
| 7,066,256 | B2 | 6/2006 | Dillenbeck et al. |
| 7,114,573 | B2 | 10/2006 | Hirth et al. |
| 7,128,154 | B2 | 10/2006 | Giroux et al. |
| 7,165,622 | B2 | 1/2007 | Hirth et al. |
| 7,182,135 | B2 | 2/2007 | Szarka |
| 7,219,730 | B2 | 5/2007 | Tilton et al. |
| 7,252,152 | B2 | 8/2007 | LoGiudice et al. |
| 7,426,964 | B2 | 9/2008 | Lynde et al. |
| 7,537,060 | B2 | 5/2009 | Fay et al. |
| 7,581,595 | B2 | 9/2009 | Fay et al. |
| 7,584,792 | B2 | 9/2009 | Szarka |
| 7,686,092 | B2 | 3/2010 | Szarka |
| 7,766,088 | B2 | 8/2010 | Saucier et al. |
| 7,845,400 | B2 | 12/2010 | Smith, Jr. et al. |
| 8,276,665 | B2 | 10/2012 | Webb et al. |
| 8,286,717 | B2 | 10/2012 | Giroux et al. |
| 8,347,964 | B2 | 1/2013 | Fisher et al. |
| 8,479,808 | B2 | 7/2013 | Gouthaman |
| 8,651,174 | B2 | 2/2014 | Barbee et al. |
| 8,668,003 | B2 | 3/2014 | Osmundsen et al. |
| 8,881,824 | B2 | 11/2014 | Stautzenberger |
| 8,997,850 | B2 | 4/2015 | Barbee et al. |
| 9,004,179 | B2 | 4/2015 | Chauffe |
| 9,068,413 | B2 | 6/2015 | Doane |
| 9,068,414 | B2 | 6/2015 | Doane |
| 9,080,404 | B2 | 7/2015 | Kalb et al. |
| 9,121,232 | B2 | 9/2015 | Abraham et al. |
| 9,212,531 | B2 | 12/2015 | Robichaux et al. |
| 9,428,998 | B2 | 8/2016 | Turley et al. |
| 2003/0230405 | A1 | 12/2003 | Allamon et al. |
| 2005/0006106 | A1 | 1/2005 | Hirth et al. |
| 2006/0124295 | A1 | 6/2006 | Maguire |
| 2007/0272413 | A1 | 11/2007 | Rytlewski et al. |
| 2009/0266544 | A1 | 10/2009 | Redlinger et al. |
| 2009/0272544 | A1 | 11/2009 | Giroux et al. |
| 2010/0051264 | A1 | 3/2010 | Willauer |
| 2010/0181079 | A1 | 7/2010 | Johnson et al. |
| 2011/0000663 | A1 | 1/2011 | Brandsdal |
| 2011/0061876 | A1 | 3/2011 | Johnson et al. |
| 2011/0240311 | A1 | 10/2011 | Robison et al. |
| 2012/0061100 | A1 | 3/2012 | Bræker |
| 2012/0067594 | A1 | 3/2012 | Noske et al. |
| 2013/0299196 | A1 | 11/2013 | Kolle |
| 2013/0327532 | A1 | 12/2013 | Ring et al. |
| 2014/0008083 | A1 | 1/2014 | Ring et al. |
| 2014/0116713 | A1 | 5/2014 | Broussard et al. |
| 2014/0138101 | A1 | 5/2014 | Arabsky et al. |
| 2014/0151037 | A1* | 6/2014 | Morgan-Smith ..... E21B 47/024 166/255.2 |
| 2014/0196912 | A1 | 7/2014 | Turley et al. |
| 2014/0262234 | A1 | 9/2014 | Walton et al. |
| 2014/0305662 | A1 | 10/2014 | Giroux et al. |
| 2015/0136393 | A1 | 5/2015 | Turley et al. |
| 2015/0136394 | A1 | 5/2015 | Turley et al. |
| 2015/0136395 | A1 | 5/2015 | Turley et al. |
| 2015/0136396 | A1 | 5/2015 | Turley et al. |

OTHER PUBLICATIONS

EPO Examination Report dated Jan. 23, 2017, for European Application No. 14192224.5.

Weatherford—WellMaster All-in-One Deepwater System brochure, date unknown, 1 page.

Weatherford—Liner Hanger Selection brochure, May 2006, 24 pages.

Weatherford—HNG Hydraulic-Release Running Tool brochure, 2006, 1 page.

Weatherford—Weatherford's Linear Systems—Hang Tough brochure, 2008-2012, 16 pages.

Weatherford—SwageSet Series Liner-Top Packer brochure, 2011-2013, 6 pages.

Australian Office Action in related application AU2014259559 dated Aug. 4, 2015.

* cited by examiner

TELEMETRY OPERATED CEMENTING PLUG RELEASE SYSTEM

BACKGROUND OF THE DISCLOSURE

Field of the Disclosure

The present disclosure generally relates to a telemetry operated cementing plug release system.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

During a cementing operation for a liner or subsea casing string, the casing/liner is deployed into the wellbore at the end of a work string. The work string includes a wiper plug at a lower end thereof. The process of releasing the wiper plug downhole is typically accomplished by pumping a dart down the work string. The dart is pumped downward by injecting cement slurry or other desired circulating fluid into the wellbore under pressure. The fluid forces the dart downward into the wellbore until it contacts a seat in the wiper plug. The dart sealingly lands into the wiper plug. Hydraulic pressure from the injected fluid ultimately causes a releasable connection between the wiper plug and work string to release, thereby allowing the dart and the wiper plug to be pumped downhole as a single plug. This consolidated wiper plug separates the fluid above the plug from fluid below the plug.

A variety of mechanisms have been employed to retain and subsequently release wiper plugs. Many of these utilize a sliding sleeve that is held in place by a shearable device. When the dart lands in the sliding sleeve, the shearable device is sheared and the sleeve moves down, allowing the plug to release. Certain disadvantages exist with the use of these release mechanisms. For example, during well completion operations, the release mechanism is subjected to various stresses which may cause premature release of the wiper plug. In some situations the sliding sleeve is subjected to an impact load by a ball or other device as it passes through the inside of the plug. In other situations, a pressure wave may impact the releasable mechanism. In either of these situations, it is possible for the sliding sleeve to shear and to thereby inadvertently or prematurely release the wiper plug.

SUMMARY OF THE DISCLOSURE

The present disclosure generally relates to a telemetry operated cementing plug release system. In one embodiment, a plug release system for cementing a tubular string into a wellbore includes: a wiper plug; a tubular housing; a latch for releasably connecting the wiper plug to the housing. The latch includes: a fastener engageable with one of the wiper plug and the housing; a lock movable between a locked position and an unlocked position, the lock keeping the fastener engaged in the locked position; and an actuator connected to the lock and operable to at least move the lock from the locked position to the unlocked position. The plug release system further includes an electronics package disposed in the housing and in communication with the actuator for operating the actuator in response to receiving a command signal.

In another embodiment, a method of hanging an inner tubular string from an outer tubular string cemented in a wellbore includes: running the inner tubular string and a deployment assembly into the wellbore using a deployment string; pumping cement slurry into the deployment string; and driving the cement slurry through the deployment string and deployment assembly while sending a command signal to a plug release system of the deployment assembly, wherein the plug release system releases a wiper plug in response to receiving the command signal.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
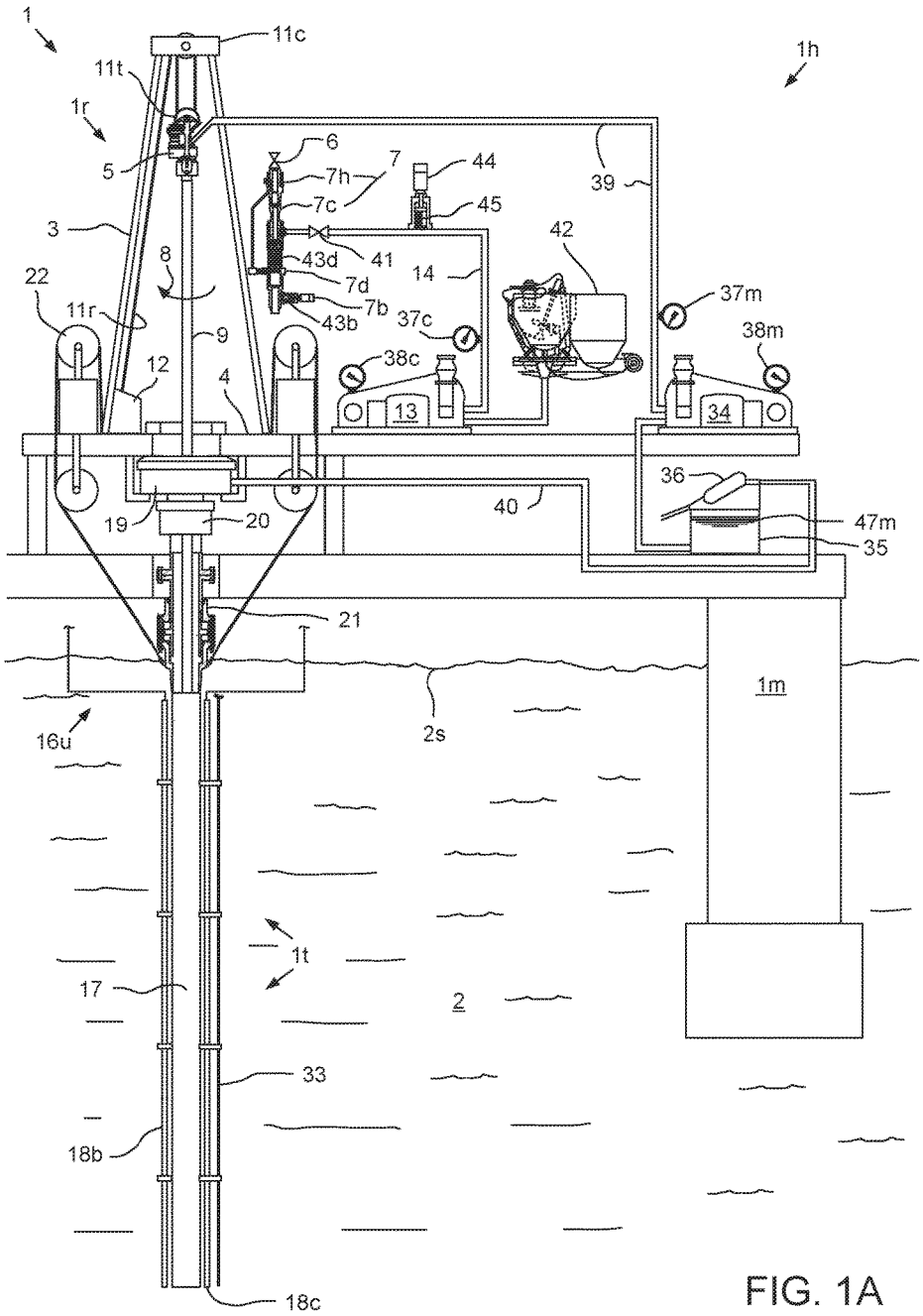
FIGS. 1A-1C illustrate a drilling system in a liner deployment mode, according to one embodiment of this disclosure.
Figure 1B:
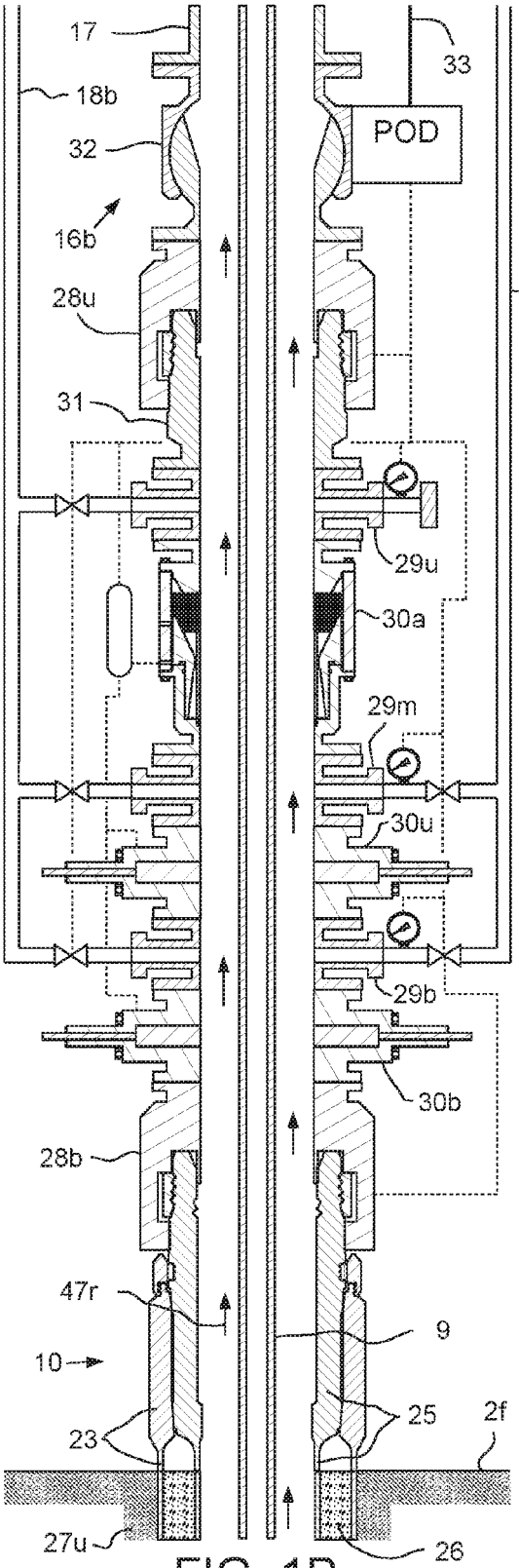
Figure 1C:
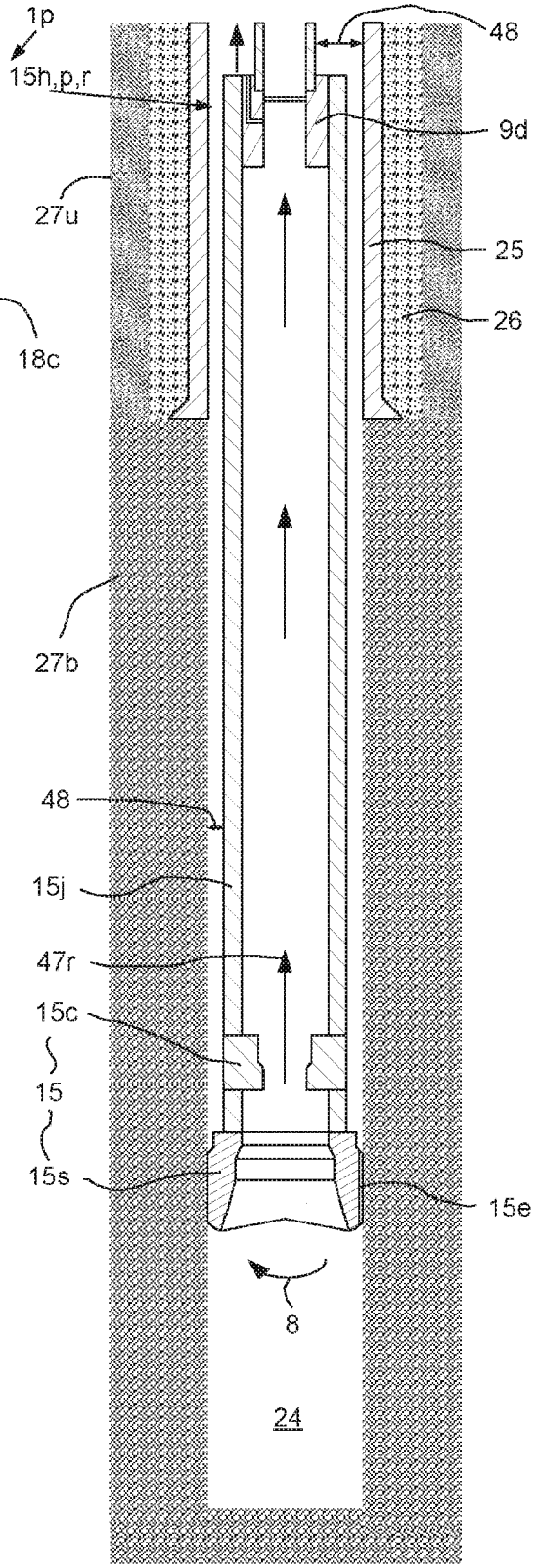

FIGS. 1A-1C illustrate a drilling system in a liner deployment mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system it, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4, a top drive 5, a cementing head 7, and a hoist. The top drive 5 may include a motor for rotating 8 the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The frame of the top drive 5 may be suspended from the derrick 3 by the traveling block 11*t*. The quill may be torsionally driven by the top drive motor and supported from the frame by bearings. The top drive may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3. The drilling rig 1*r* may further include a drill string compensator (not shown) to account for heave of the MODU 1*m*. The drill string compensator may be disposed between the traveling block 11*t* and the top drive 5 (aka hook mounted) or between the crown block 11*c* and the derrick 3 (aka top mounted).

Alternatively, a Kelly and rotary table may be used instead of the top drive.

Figures 2A, 2B, 2C, 2D:
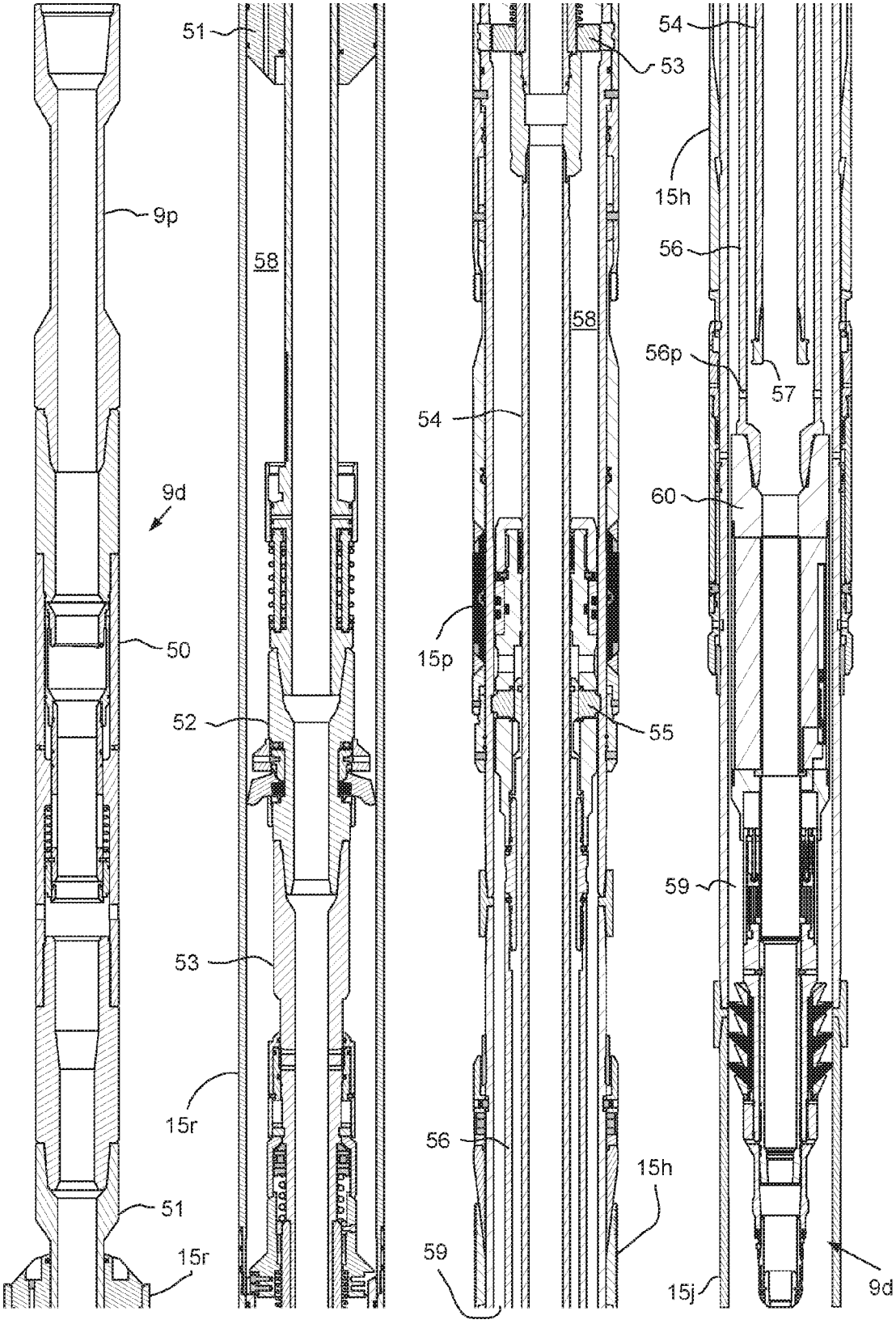
FIGS. 2A-2D illustrate a liner deployment assembly (LDA) of the drilling system.

In the deployment mode, an upper end of the workstring 9 may be connected to the top drive quill, such as by threaded couplings. The workstring 9 may include a liner deployment assembly (LDA) 9*d* and a deployment string, such as joints of drill pipe 9*p* (FIG. 2A) connected together, such as by threaded couplings. An upper end of the LDA 9*d* may be connected a lower end of the drill pipe 9*p*, such as by threaded couplings. The LDA 9*d* may also be connected to a liner string 15. The liner string 15 may include a polished bore receptacle (PBR) 15*r*, a packer 15*p*, a liner hanger 15*h*, joints of liner 15*j*, a landing collar 15*c*, and a reamer shoe 15*s*. The liner string members may each be connected together, such as by threaded couplings. The reamer shoe 15*s* may be rotated 8 by the top drive 5 via the workstring 9.

Alternatively, drilling fluid may be injected into the liner string during deployment thereof. Alternatively, drilling fluid may be injected into the liner string and the liner string 15 may include a drillable drill bit (not shown) instead of the reamer shoe 15*s* and the liner string may be drilled into the lower formation 27*b*, thereby extending the wellbore 24 while deploying the liner string.

Once liner deployment has concluded, the workstring 9 may be disconnected from the top drive and the cementing head 7 may be inserted and connected therebetween. The cementing head 7 may include an isolation valve 6, an actuator swivel 7*h*, a cementing swivel 7*c*, and one or more plug launchers, such as a dart launcher 7*d* and a ball launcher 7*b*. The isolation valve 6 may be connected to a quill of the top drive 5 and an upper end of the actuator swivel 7*h*, such as by threaded couplings. An upper end of the workstring 9 may be connected to a lower end of the cementing head 7, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation 8 of the mandrel. An upper end of the mandrel may be connected to a lower end of the actuator swivel, such as by threaded couplings. The cementing swivel 7*c* may further include an inlet formed through a wall of the housing and in fluid communication with a port formed through the mandrel and a seal assembly for isolating the inlet-port communication. The cementing mandrel port may provide fluid communication between a bore of the cementing head and the housing inlet. The seal assembly may include one or more stacks of V-shaped seal rings, such as opposing stacks, disposed between the mandrel and the housing and straddling the inlet-port interface. The actuator swivel 7*h* may be similar to the cementing swivel 7*c* except that the housing may have two inlets in fluid communication with respective passages formed through the mandrel. The mandrel passages may extend to respective outlets of the mandrel for connection to respective hydraulic conduits (only one shown) for operating respective hydraulic actuators of the launchers 7*b,d*. The actuator swivel inlets may be in fluid communication with a hydraulic power unit (HPU, not shown).

Alternatively, the seal assembly may include rotary seals, such as mechanical face seals.

The dart launcher 7*d* may include a body, a diverter, a canister, a latch, and the actuator. The body may be tubular and may have a bore therethrough. To facilitate assembly, the body may include two or more sections connected together, such as by threaded couplings. An upper end of the body may be connected to a lower end of the actuator swivel, such as by threaded couplings and a lower end of the body may be connected to the workstring 9. The body may further have a landing shoulder formed in an inner surface thereof. The canister and diverter may each be disposed in the body bore. The diverter may be connected to the body, such as by threaded couplings. The canister may be longitudinally movable relative to the body. The canister may be tubular and have ribs formed along and around an outer surface thereof. Bypass passages may be formed between the ribs.

The canister may further have a landing shoulder formed in a lower end thereof corresponding to the body landing shoulder. The diverter may be operable to deflect fluid received from a cement line 14 away from a bore of the canister and toward the bypass passages. A release plug, such as dart 43*d*, may be disposed in the canister bore.

The latch may include a body, a plunger, and a shaft. The latch body may be connected to a lug formed in an outer surface of the launcher body, such as by threaded couplings. The plunger may be longitudinally movable relative to the latch body and radially movable relative to the launcher body between a capture position and a release position. The plunger may be moved between the positions by interaction, such as a jackscrew, with the shaft. The shaft may be longitudinally connected to and rotatable relative to the latch body. The actuator may be a hydraulic motor operable to rotate the shaft relative to the latch body.

The ball launcher 7*b* may include a body, a plunger, an actuator, and a setting plug, such as a ball 43*b*, loaded therein. The ball launcher body may be connected to another lug formed in an outer surface of the dart launcher body, such as by threaded couplings. The ball 43*b* may be disposed in the plunger for selective release and pumping downhole through the drill pipe 9*p* to the LDA 9*d*. The plunger may be movable relative to the respective dart launcher body between a captured position and a release position. The plunger may be moved between the positions by the actuator. The actuator may be hydraulic, such as a piston and cylinder assembly.

Alternatively, the actuator swivel and launcher actuators may be pneumatic or electric. Alternatively, the launcher actuators may be linear, such as piston and cylinders.

In operation, when it is desired to launch one of the plugs 43*b,d*, the HPU may be operated to supply hydraulic fluid to the appropriate launcher actuator via the actuator swivel 7*h*. The selected launcher actuator may then move the plunger to the release position (not shown). If the dart launcher 7*d* is selected, the canister and dart 43*d* may then move downward relative to the housing until the landing shoulders engage. Engagement of the landing shoulders may close the canister bypass passages, thereby forcing fluid to flow into the canister bore. The fluid may then propel the dart 43*d* from the canister bore into a lower bore of the housing and onward through the workstring 9. If the ball launcher 7*b* was selected, the plunger may carry the ball 43*b* into the launcher housing to be propelled into the drill pipe 9*p* by the fluid.

The fluid transport system 1*t* may include an upper marine riser package (UMRP) 16*u*, a marine riser 17, a booster line 18*b*, and a choke line 18*c*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 21, such as by a flanged connection. The diverter 21 may also be connected to the rig floor 4, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and a casing string 25 may be deployed into the wellbore. The casing string 25 may include a wellhead housing and joints of casing connected together, such as by threaded couplings. The wellhead housing may land in the conductor housing during deployment of the casing string 25. The casing string 25 may be cemented 26 into the wellbore 24. The casing string 25 may extend to a depth adjacent a bottom of the upper formation 27*u*. The wellbore 24 may then be extended into the lower formation 27*b* using a pilot bit and underreamer (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a rig controller (not shown) onboard the MODU 1*m* via an umbilical 33. The control pod may include one or more control valves (not shown) in communication with the BOPs 30*a,u,b* for operation thereof. Each control valve may include an electric or hydraulic actuator in communication with the umbilical 33. The umbilical 33 may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The rig controller may operate the PCA 1*p* via the umbilical 33 and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump (not shown). A lower end of the choke line 18*c* may have prongs connected to respective second branches of the flow crosses 29*m,b*. Shutoff valves may be disposed in respective prongs of the choke line lower end.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33 may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical may be extended between the MODU and the PCA independently of the riser. Alternatively, the shutoff valve actuators may be electrical or pneumatic.

The fluid handling system 1*h* may include one or more pumps, such as a cement pump 13 and a mud pump 34, a reservoir for drilling fluid 47*m*, such as a tank 35, a solids separator, such as a shale shaker 36, one or more pressure gauges 37*c,m*, one or more stroke counters 38*c,m*, one or more flow lines, such as cement line 14, mud line 39, and return line 40, a cement mixer 42, and a tag launcher 44. The drilling fluid 47*m* may include a base liquid. The base liquid may be refined or synthetic oil, water, brine, or a water/oil emulsion. The drilling fluid 47*m* may further include solids dissolved or suspended in the base liquid, such as organophilic clay, lignite, and/or asphalt, thereby forming a mud.

A first end of the return line 40 may be connected to the diverter outlet and a second end of the return line may be connected to an inlet of the shaker 36. A lower end of the mud line 39 may be connected to an outlet of the mud pump 34 and an upper end of the mud line may be connected to the top drive inlet. The pressure gauge 37*m* may be assembled as part of the mud line 39. An upper end of the cement line 14 may be connected to the cementing swivel inlet and a lower end of the cement line may be connected to an outlet of the cement pump 13. The tag launcher 44, a shutoff valve 41, and the pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The tag launcher 44 may include a housing, a plunger, an actuator, and a magazine (not shown) having a plurality of wireless identification tags, such as radio frequency identification (RFID) tags loaded therein. A chambered RFID tag 45 may be disposed in the respective plunger for selective release and pumping downhole to communicate with the LDA 9*d*. The plunger may be movable relative to the launcher housing between a captured position and a release position. The plunger may be moved between the positions by the actuator. The actuator may be hydraulic, such as a piston and cylinder assembly.

Alternatively, the actuator may be electric or pneumatic. Alternatively, the actuator may be manual, such as a handwheel. Alternatively, the tag 45 may be manually launched by breaking a connection in the respective line. Alternatively, the plug launcher may be part of the cementing head.

The workstring 9 may be rotated 8 by the top drive 5 and lowered by the traveling block 11*t*, thereby reaming the liner string 15 into the lower formation 27*b*. Drilling fluid in the wellbore 24 may be displaced through courses 15*e* of the reamer shoe 15*s*, where the fluid may circulate cuttings away from the shoe and return the cuttings into a bore of the liner string 15. The returns 47*r* (drilling fluid plus cuttings) may flow up the liner bore and into a bore of the LDA 9*d*. The returns 47*r* may flow up the LDA bore and to a diverter valve 50 (FIG. 2A) thereof. The returns 47*r* may be diverted into an annulus 48 formed between the workstring 9/liner string 15 and the casing string 25/wellbore 24 by the diverter valve 50. The returns 47*r* may exit the wellbore 24 and flow into an annulus formed between the riser 17 and the drill pipe 9*p* via an annulus of the LMRP 16*b*, BOP stack, and wellhead 10. The returns may exit the riser annulus and enter the return line 40 via an annulus of the UMRP 16*u* and the diverter 19. The returns 47*r* may flow through the return line 40 and into the shale shaker inlet. The returns 47*r* may be processed by the shale shaker 36 to remove the cuttings.

FIGS. 2A-2D illustrate the liner deployment assembly LDA 9*d*. The LDA 9*d* may include a diverter valve 50, a junk bonnet 51, a setting tool 52, a running tool 53, a stinger 54, a packoff 55, a spacer 56, a release 57, and a plug release system 60.

An upper end of the diverter valve 50 may be connected to a lower end the drill pipe 9*p* and a lower end of the diverter valve 50 may be connected to an upper end of the junk bonnet 51, such as by threaded couplings. A lower end of the junk bonnet 51 may be connected to an upper end of the setting tool 52 and a lower end of the setting tool may be connected to an upper end of the running tool 53, such as by threaded couplings. The running tool 53 may also be fastened to the packer 15*p*. An upper end of the stinger 54 may be connected to a lower end of the running tool 53 and a lower end of the stringer may be connected to the release 57, such as by threaded couplings. The stinger 54 may extend through the upper packoff 55. The upper packoff 55 may be fastened to the packer 15*p*. An upper end of the spacer 56 may be connected to a lower end of the upper packoff 55, such as by threaded couplings. An upper end of the plug release system 60 may be connected to a lower end of the spacer 56, such as by threaded couplings.

The diverter valve 50 may include a housing, a bore valve, and a port valve. The diverter housing may include two or more tubular sections (three shown) connected to each other, such as by threaded couplings. The diverter housing may have threaded couplings formed at each longitudinal end thereof for connection to the drill pipe 9*p* at an upper end thereof and the junk bonnet 51 at a lower end thereof. The bore valve may be disposed in the housing. The bore valve may include a body and a valve member, such as a flapper, pivotally connected to the body and biased toward a closed position, such as by a torsion spring. The flapper may be oriented to allow downward fluid flow from the drill pipe 9*p* through the rest of the LDA 9*d* and prevent reverse upward flow from the LDA to the drill pipe 9*p*. Closure of the flapper may isolate an upper portion of a bore of the diverter valve from a lower portion thereof. Although not shown, the body may have a fill orifice formed through a wall thereof and bypassing the flapper.

Figures 4A, 4B, 4C, 4D:
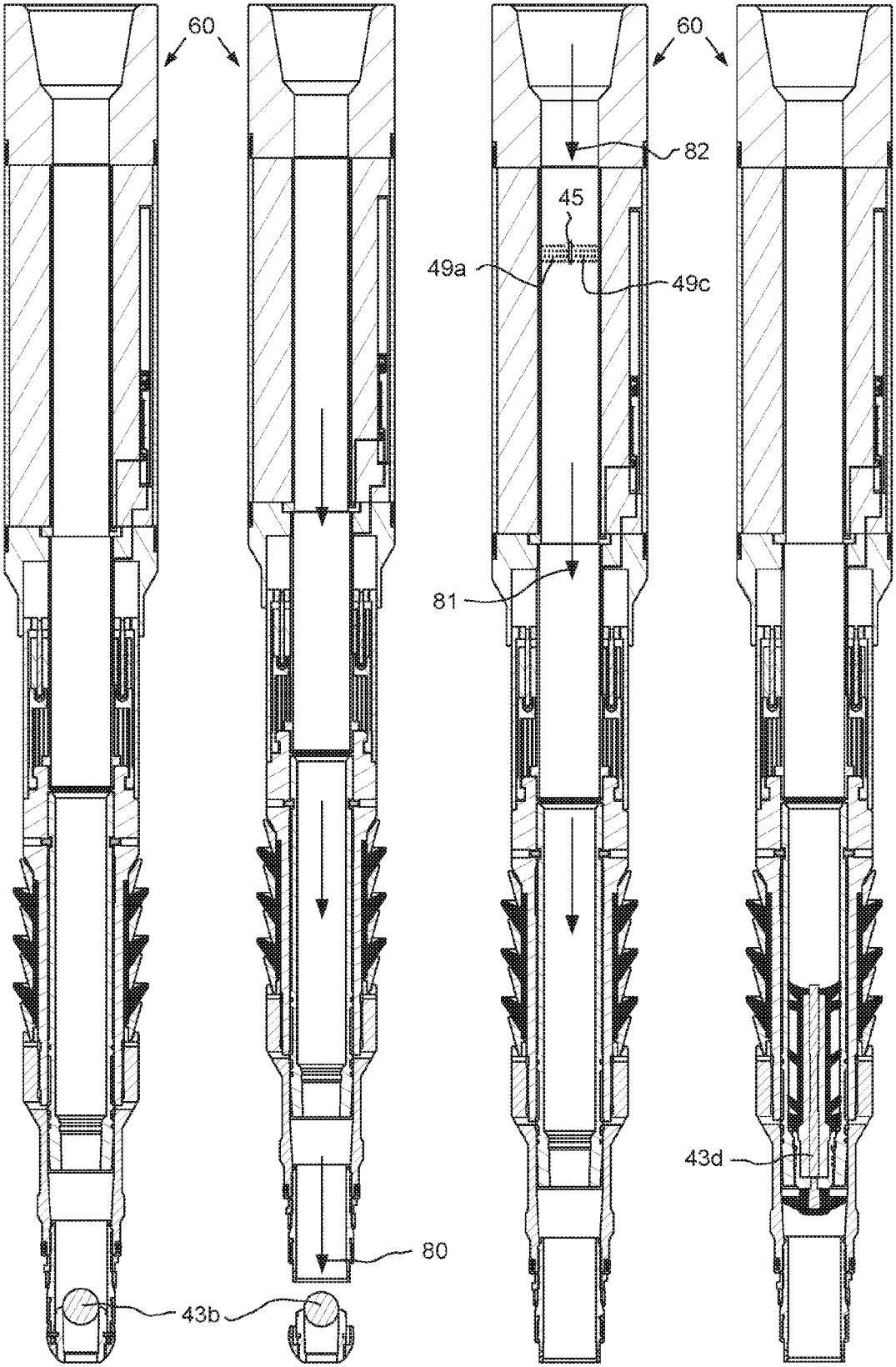
FIGS. 4A-4F illustrate operation of the plug release system.

The diverter port valve may include a sleeve and a biasing member, such as a compression spring. The sleeve may include two or more sections (four shown) connected to each other, such as by threaded couplings and/or fasteners. An upper section of the sleeve may be connected to a lower end of the bore valve body, such as by threaded couplings. Various interfaces between the sleeve and the housing and between the housing sections may be isolated by seals. The sleeve may be disposed in the housing and longitudinally movable relative thereto between an upper position (shown) and a lower position (FIG. 4A). The sleeve may be stopped in the lower position against an upper end of the lower housing section and in the upper position by the bore valve body engaging a lower end of the upper housing section. The mid housing section may have one or more flow ports and one or more equalization ports formed through a wall thereof. One of the sleeve sections may have one or more equalization slots formed therethrough providing fluid communication between a spring chamber formed in an inner surface of the mid housing section and the lower bore portion of the diverter valve 50.

One of the sleeve sections may cover the housing flow ports when the sleeve is in the lower position, thereby closing the housing flow ports and the sleeve section may be clear of the flow ports when the sleeve is in the upper position, thereby opening the flow ports. In operation, surge pressure of the returns 47*r* generated by deployment of the LDA 9*d* and liner string 15 into the wellbore may be exerted on a lower face of the closed flapper. The surge pressure may push the flapper upward, thereby also pulling the sleeve upward against the compression spring and opening the housing flow ports. The surging returns 47*r* may then be diverted through the open flow ports by the closed flapper. Once the liner string 15 has been deployed, dissipation of the surge pressure may allow the spring to return the sleeve to the lower position.

The junk bonnet 51 may include a piston, a mandrel, and a release valve. Although shown as one piece, the mandrel may include two or more sections connected to each other, such as by threaded couplings and/or fasteners. The mandrel may have threaded couplings formed at each longitudinal end thereof for connection to the diverter valve 50 at an upper end thereof and the setting tool 52 at a lower end thereof.

The piston may be an annular member having a bore formed therethrough. The mandrel may extend through the piston bore and the piston may be longitudinally movable relative thereto subject to entrapment between an upper shoulder of the mandrel and the release valve. The piston may carry one or more (two shown) outer seals and one or more (two shown) inner seals. Although not shown, the junk bonnet 51 may further include a split seal gland carrying each piston inner seal and a retainer for connecting the each seal gland to the piston, such as by a threaded connection. The inner seals may isolate an interface between the piston and the mandrel.

The piston may also be disposed in a bore of the PBR 15*r* adjacent an upper end thereof and be longitudinally movable relative thereto. The outer seals may isolate an interface between the piston and the PBR 15*r*, thereby forming an upper end of a buffer chamber 58. A lower end of the buffer chamber 58 may be formed by a sealed interface between the packoff 55 and the packer 15*p*. The buffer chamber 58 may be filled with a hydraulic fluid (not shown), such as fresh water or oil, such that the piston may be hydraulically locked in place. The buffer chamber 58 may prevent infiltration of debris from the wellbore 24 from obstructing operation of the LDA 9*d*. The piston may include a fill passage extending longitudinally therethrough closed by a plug. The mandrel may include a bypass groove formed in and along an outer surface thereof. The bypass groove may create a leak path through the piston inner seals during removal of the LDA 9*d* from the liner string 15 to release the hydraulic lock.

The release valve may include a shoulder formed in an outer surface of the mandrel, a closure member, such as a sleeve, and one or more biasing members, such as compression springs. Each spring may be carried on a rod and trapped between a stationary washer connected to the rod and a washer slidable along the rod. Each rod may be disposed in a pocket formed in an outer surface of the mandrel. The sleeve may have an inner lip trapped formed at a lower end thereof and extending into the pockets. The lower end may also be disposed against the slidable washer. The valve shoulder may have one or more one or more radial ports formed therethrough. The valve shoulder may carry a pair of seals straddling the radial ports and engaged with the valve sleeve, thereby isolating the mandrel bore from the buffer chamber 58.

The piston may have a torsion profile formed in a lower end thereof and the valve shoulder may have a complementary torsion profile formed in an upper end thereof. The piston may further have reamer blades formed in an upper surface thereof. The torsion profiles may mate during removal of the LDA 9*d* from the liner string 15, thereby torsionally connecting the piston to the mandrel. The piston may then be rotated during removal to back ream debris accumulated adjacent an upper end of the PBR 15*r*. The piston lower end may also seat on the valve sleeve during removal. Should the bypass groove be clogged, pulling of the drill pipe 9*p* may cause the valve sleeve to be pushed downward relative to the mandrel and against the springs to open the radial ports, thereby releasing the hydraulic lock.

Alternatively, the piston may include two elongate hemi-annular segments connected together by fasteners and having gaskets clamped between mating faces of the segments to inhibit end-to-end fluid leakage. Alternatively, the piston may have a radial bypass port formed therethrough at a location between the upper and lower inner seals and the bypass groove may create the leak path through the lower inner seal to the bypass port. Alternatively, the valve sleeve may be fastened to the mandrel by one or more shearable fasteners.

The setting tool 52 may include a body, a plurality of fasteners, such as dogs, and a rotor. Although shown as one piece, the body may include two or more sections connected to each other, such as by threaded couplings and/or fasteners. The body may have threaded couplings formed at each longitudinal end thereof for connection to the junk bonnet 51 at an upper end thereof and the running tool 53 at a lower end thereof. The body may have a recess formed in an outer surface thereof for receiving the rotor. The rotor may include a thrust ring, a thrust bearing, and a guide ring. The guide ring and thrust bearing may be disposed in the recess. The thrust bearing may have an inner race torsionally connected to the body, such as by press fit, an outer race torsionally connected to the thrust ring, such as by press fit, and a rolling element disposed between the races. The thrust ring may be connected to the guide ring, such as by one or more threaded fasteners. An upper portion of a pocket may be formed between the thrust ring and the guide ring. The setting tool 52 may further include a retainer ring connected to the body adjacent to the recess, such as by one or more threaded fasteners. A lower portion of the pocket may be formed between the body and the retainer ring. The dogs may be disposed in the pocket and spaced around the pocket.

Each dog may be movable relative to the rotor and the body between a retracted position (shown) and an extended position. Each dog may be urged toward the extended position by a biasing member, such as a compression spring. Each dog may have an upper lip, a lower lip, and an opening. An inner end of each spring may be disposed against an outer surface of the guide ring and an outer portion of each spring may be received in the respective dog opening. The upper lip of each dog may be trapped between the thrust ring and the guide ring and the lower lip of each dog may be trapped between the retainer ring and the body. Each dog may also be trapped between a lower end of the thrust ring and an upper end of the retainer ring. Each dog may also be torsionally connected to the rotor, such as by a pivot fastener (not shown) received by the respective dog and the guide ring.

The running tool 53 may include a body, a lock, a clutch, and a latch. The body may include two or more tubular sections (two shown) connected to each other, such as by threaded couplings. The body may have threaded couplings formed at each longitudinal end thereof for connection to the setting tool 52 at an upper end thereof and the stinger 54 at a lower end thereof. The latch may longitudinally and torsionally connect the liner string 15 to an upper portion of the LDA 9*d*. The latch may include a thrust cap having one or more torsional fasteners, such as keys, and a longitudinal fastener, such as a floating nut. The keys may mate with a torsional profile formed in an upper end of the packer 15*p* and the floating nut may be screwed into threaded dogs of the packer. The lock may be disposed on the body to prevent premature release of the latch from the liner string 15. The clutch may selectively torsionally connect the thrust cap to the body.

The lock may include a piston, a plug, one or more fasteners, such as dogs, and a sleeve. The plug may be connected to an outer surface of the body, such as by threaded couplings. The plug may carry an inner seal and an outer seal. The inner seal may isolate an interface formed between the plug and the body and the outer seal may isolate an interface formed between the plug and the piston. The piston may have an upper portion disposed along an outer surface of the body and an enlarged lower portion disposed along an outer surface of the plug. The piston may carry an inner seal in the upper portion for isolating an interface formed between the body and the piston. The piston may be fastened to the body, such as by one or more shearable fasteners. An actuation chamber may be formed between the piston, plug, and body. The body may have one or more ports formed through a wall thereof providing fluid communication between the chamber and a bore of the body.

The lock sleeve may have an upper portion disposed along an outer surface of the body and extending into the piston lower portion and an enlarged lower portion. The lock sleeve may have one or more openings formed therethrough and spaced around the sleeve to receive a respective dog therein. Each dog may extend into a groove formed in an outer surface of the body, thereby fastening the lock sleeve to the body. A thrust bearing may be disposed in the lock sleeve lower portion and against a shoulder formed in an outer surface of the body. The thrust bearing may be biased against the body shoulder by a compression spring.

The body may have a torsional profile, such as one or more keyways formed in an outer surface thereof adjacent to a lower end of the upper body section. A key may be disposed in each of the keyways. A lower end of the compression spring may bear against the keyways.

The thrust cap may be linked to the lock sleeve, such as by a lap joint. The latch keys may be connected to the thrust cap, such as by one or more threaded fasteners. A shoulder may be formed in an inner surface of the thrust cap dividing an upper enlarged portion from a lower enlarged portion of the thrust cap. The shoulder and enlarged lower portion may receive an upper portion of a biasing member, such as a compression spring. A lower end of the compression spring may be received by a shoulder formed in an upper end of the float nut.

The float nut may be urged against a shoulder formed by an upper end of the lower housing section by the compression spring. The float nut may have a thread formed in an outer surface thereof. The thread may be opposite-handed, such as left handed, relative to the rest of the threads of the workstring 9. The float nut may be torsionally connected to the body by having one or more keyways formed along an inner surface thereof and receiving the keys, thereby providing upward freedom of the float nut relative to the body while maintaining torsional connection.

The clutch may include a gear and a lead nut. The gear may be formed by one or more teeth connected to the thrust cap, such as by a threaded fastener. The teeth may mesh with the keys, thereby torsionally connecting the thrust cap to the body. The lead nut may be disposed in a threaded passage formed in an inner surface of the thrust cap upper enlarged portion and have a threaded outer surface meshed with the thrust cap thread, thereby longitudinally connecting the lead nut and thrust cap while providing torsional freedom therebetween. The lead nut may be torsionally connected to the body by having one or more keyways formed along an inner surface thereof and receiving the keys, thereby providing longitudinal freedom of the lead nut relative to the body while maintaining torsional connection. Threads of the lead nut and thrust cap may have a finer pitch, opposite hand, and greater number than threads of the float nut and packer dogs to facilitate lesser (and opposite) longitudinal displacement per rotation of the lead nut relative to the float nut.

In operation, once the liner hanger 15*h* has been set, the lock may be released by supplying sufficient fluid pressure through the body ports. Weight may then be set down on the liner string, thereby pushing the thrust cap upward and disengaging the clutch gear. The workstring may then be rotated to cause the lead nut to travel down the threaded passage of the thrust cap while the float nut travels upward relative to the threaded dogs of the packer. The float nut may disengage from the threaded dogs before the lead nut bottoms out in the threaded passage. Rotation may continue to bottom out the lead nut, thereby restoring torsional connection between the thrust cap and the body.

Alternatively, the running tool may be replaced by a hydraulically released running tool. The hydraulically released running tool may include a piston, a shearable stop, a torsion sleeve, a longitudinal fastener, such as a collet, a cap, a case, a spring, a body, and a catch. The collet may have a plurality of fingers each having a lug formed at a bottom thereof. The finger lugs may engage a complementary portion of the packer 15*p*, thereby longitudinally connecting the running tool to the liner string 15. The torsion sleeve may have keys for engaging the torsion profile formed in the packer 15*p*. The collet, case, and cap may be longitudinally movable relative to the body subject to limitation by the stop. The piston may be fastened to the body by one or more shearable fasteners and fluidly operable to release the collet fingers when actuated by a threshold release pressure. In operation, fluid pressure may be increased to push the piston and fracture the shearable fasteners, thereby releasing the piston. The piston may then move upward toward the collet until the piston abuts the collet and fractures the stop. The latch piston may continue upward movement while carrying the collet, case, and cap upward until a bottom of the torsion sleeve abuts the fingers, thereby pushing the fingers radially inward. The catch may be a split ring biased radially inward and disposed between the collet and the case. The body may include a recess formed in an outer surface thereof. During upward movement of the piston, the catch may align and enter the recess, thereby preventing reengagement of the fingers. Movement of the piston may continue until the cap abuts a stop shoulder of the body, thereby ensuring complete disengagement of the fingers.

An upper end of an actuation chamber 59 may be formed by the sealed interface between the packoff 55 and the packer 15*p*. A lower end of the actuation chamber 59 may be formed by the sealed interface between a cementing plug of the plug release system 60 and the liner hanger 15*h*. The actuation chamber 59 may be in fluid communication with the LDA bore (above a ball seat of the plug release system 60) via one or more ports 56*p* formed through a wall of the spacer 56.

The packoff 55 may include a cap, a body, an inner seal assembly, such as a seal stack, an outer seal assembly, such as a cartridge, one or more fasteners, such as dogs, a lock sleeve, an adapter, and a detent. The packoff 55 may be tubular and have a bore formed therethrough. The stinger 54 may be received through the packoff bore and an upper end of the spacer 56 may be fastened to a lower end of the packoff 55. The packoff 55 may be fastened to the packer 15*p* by engagement of the dogs with an inner surface of the packer.

The seal stack may be disposed in a groove formed in an inner surface of the body. The seal stack may be connected to the body by entrapment between a shoulder of the groove and a lower face of the cap. The seal stack may include an upper adapter, an upper set of one or more directional seals, a center adapter, a lower set of one or more directional seals, and a lower adapter. The cartridge may be disposed in a groove formed in an outer surface of the body. The cartridge may be connected to the body by entrapment between a shoulder of the groove and a lower end of the cap. The cartridge may include a gland and one or more (two shown) seal assemblies. The gland may have a groove formed in an outer surface thereof for receiving each seal assembly. Each seal assembly may include a seal, such as an S-ring, and a pair of anti-extrusion elements, such as garter springs.

The body may also carry a seal, such as an O-ring, to isolate an interface formed between the body and the gland. The body may have one or more (two shown) equalization ports formed through a wall thereof located adjacently below the cartridge groove. The body may further have a stop shoulder formed in an inner surface thereof adjacent to the equalization ports. The lock sleeve may be disposed in a bore of the body and longitudinally movable relative thereto between a lower position and an upper position. The lock sleeve may be stopped in the upper position by engagement of an upper end thereof with the stop shoulder and held in the lower position by the detent. The body may have one or more openings formed therethrough and spaced around the body to receive a respective dog therein.

Each dog may extend into a groove formed in an inner surface of the packer 15*p*, thereby fastening a lower portion of the LDA 9*d* to the packer 15*p*. Each dog may be radially movable relative to the body between an extended position (shown) and a retracted position. Each dog may be extended by interaction with a cam profile formed in an outer surface of the lock sleeve. The lock sleeve may further have a taper formed in a wall thereof and collet fingers extending from the taper to a lower end thereof. The detent may include the collet fingers and a complementary groove formed in an inner surface of the body. The detent may resist movement of the lock sleeve from the lower position to the upper position.

Figure 3A:
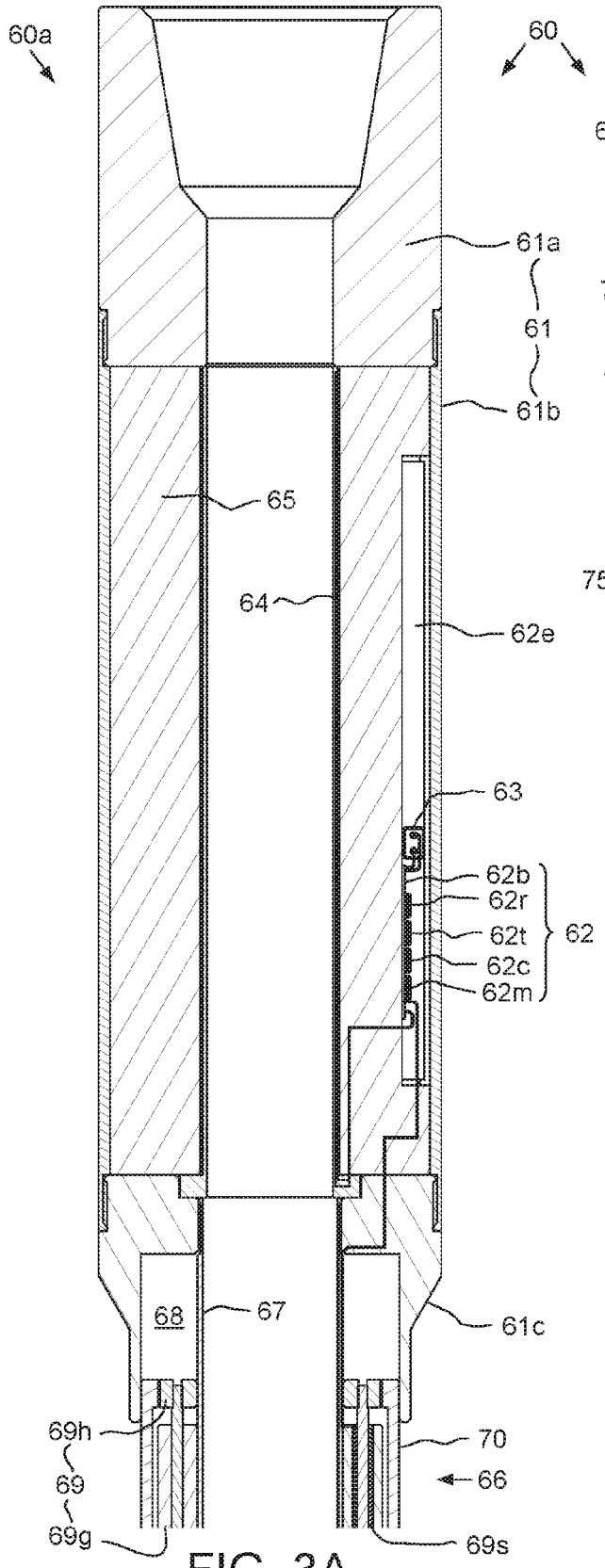
FIGS. 3A and 3B illustrate a plug release system of the LDA.
Figure 3B:
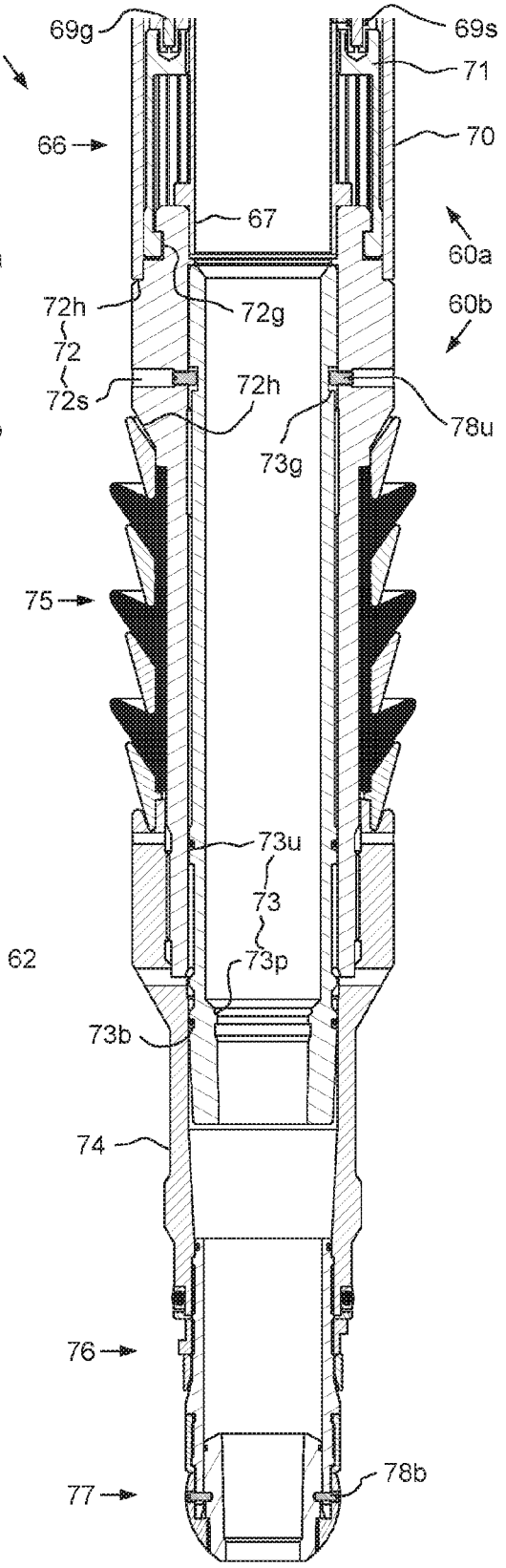

FIGS. 3A and 3B illustrate the plug release system 60. The plug release system 60 may include a launcher 60*a* and the cementing plug, such as a wiper plug 60*b*. Each of the launcher 60*a* and wiper plug 60*b* may be a tubular member having a bore formed therethrough. The launcher 60*a* may include a housing 61, an electronics package 62, a power source, such as a battery 63, an antenna 64, a mandrel 65, and a latch 66. The housing 61 may include two or more tubular sections 61*a-c* connected to each other, such as by threaded couplings. The housing 61 may have a coupling, such as a threaded coupling, formed at an upper end thereof for connection to the spacer 56. The mid housing section 61*b* may have an enlarged inner diameter to form an electronics chamber for receiving the antenna 64 and the mandrel 65.

Alternatively, the power source may be a capacitor or inductor instead of the battery.

The antenna 64 may be tubular and extend along an inner surface of the mandrel 65. The antenna 64 may include an inner liner, a coil, and a jacket. The antenna liner may be made from a non-magnetic and non-conductive material, such as a polymer or composite, have a bore formed longitudinally therethrough, and have a helical groove formed in an outer surface thereof. The antenna coil may be wound in the helical groove and made from an electrically conductive material, such as copper or alloy thereof. The antenna jacket may be made from the non-magnetic and non-conductive material and may insulate the coil. The antenna liner may have a flange formed at a lower end thereof. Leads may be connected to ends of the antenna coil and extend into the flange. The lower housing section 61*c* may have a groove formed in an upper end and inner surface thereof and the antenna flange may be disposed in the groove and trapped therein by a lower end of the mandrel, thereby connecting the antenna 64 to the housing 61.

The mandrel 65 may be a tubular member having one or more (only one shown) pockets formed in an outer surface thereof. The mandrel 65 may be connected to the housing 61 by entrapment between a lower end of the upper housing section 61*a* and an upper end of the lower housing section 61*c*. The mandrel 65, housing 61, and/or latch 66 may have electrical conduits formed in a wall thereof for receiving wires connecting the antenna 64 to the electronics package 62, connecting the battery 63 to the electronics package, and connecting the latch 66 to the electronics package. Although shown in the same pocket, the electronics package 62 and battery 63 may be disposed in respective pockets of the mandrel 65. The electronics package 62 may include a control circuit 62*c*, a transmitter 62*t*, a receiver 62*r*, and an actuator controller 62*m* integrated on a printed circuit board 62*b*. The control circuit 62*c* may include a microcontroller (MCU), a memory unit (MEM), a clock, and an analog-digital converter. The transmitter 62*t* may include an amplifier (AMP), a modulator (MOD), and an oscillator (OSC). The receiver 62*r* may include an amplifier (AMP), a demodulator (MOD), and a filter (FIL). The actuator controller 62*m* may include a power converter for converting a DC power signal supplied by the battery 63 into a suitable power signal for driving an actuator 69 of the latch 66. The electronics package 62 may be housed in an encapsulation 62*e*.

Figure 1D:
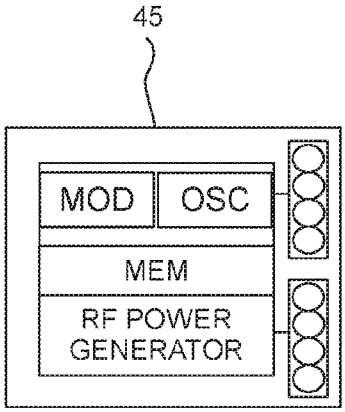
FIG. 1D illustrates a radio frequency identification (RFID) tag of the drilling system.

FIG. 1D illustrates the RFID tag 45. The RFID tag 45 may be a passive tag and include an electronics package and one or more antennas housed in an encapsulation. The electronics package may include a memory unit, a transmitter, and a radio frequency (RF) power generator for operating the transmitter. The RFID tag 45 may be programmed with a command signal addressed to the plug release system 60. The RFID tag 45 may be operable to transmit a wireless command signal (FIG. 4C) 49*c*, such as a digital electromagnetic command signal, to the antenna 64 in response to receiving an activation signal 49*a* therefrom. The MCU of the control circuit 62*c* may receive the command signal 49*c* and operate the latch actuator in response to receiving the command signal.

Figure 1E:
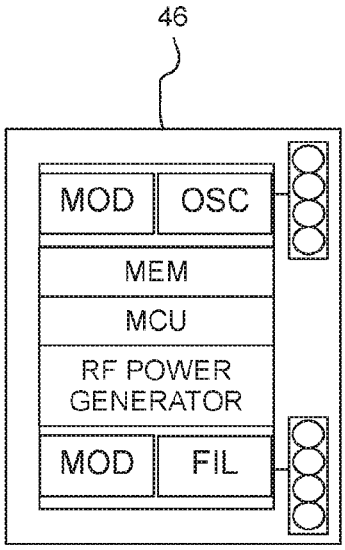
FIG. 1E illustrates an alternative RFID tag.

FIG. 1E illustrates an alternative RFID tag 46. Alternatively, the RFID tag 45 may instead be a wireless identification and sensing platform (WISP) RFID tag 46. The WISP tag 46 may further a microcontroller (MCU) and a receiver for receiving, processing, and storing data from the plug release system 60. Alternatively, the RFID tag may be an active tag having an onboard battery powering a transmitter instead of having the RF power generator or the WISP tag may have an onboard battery for assisting in data handling functions. The active tag may further include a safety, such as pressure switch, such that the tag does not begin to transmit until the tag is in the wellbore.

Returning to FIGS. 3A and 3B, the latch 66 may include a retainer sleeve 67, a receiver chamber 68, the actuator 69, a lock sleeve 70, and a fastener, such as a collet 71. An upper end of the retainer sleeve 67 may be connected to a lower end of the lower housing section 61*c*, such as by threaded couplings. The receiver chamber 68 may be formed in an inner surface of the lower housing section 61*c* and occupy a mid and lower portion thereof. The actuator 69 may be linear and include a solenoid 69*s*, a guide 69*g*, and a hub 69*h*. Each of the solenoid 69*s* and guide 69*g* may include a shaft and a cylinder. The hub 69*h* may have a threaded socket formed therethrough for each actuator shaft. An upper end of each actuator shaft may be threaded and received in the respective socket, thereby connecting the solenoid 69*s* and guide 69*g* to the hub 69*h*.

Figures 4E, 4F:
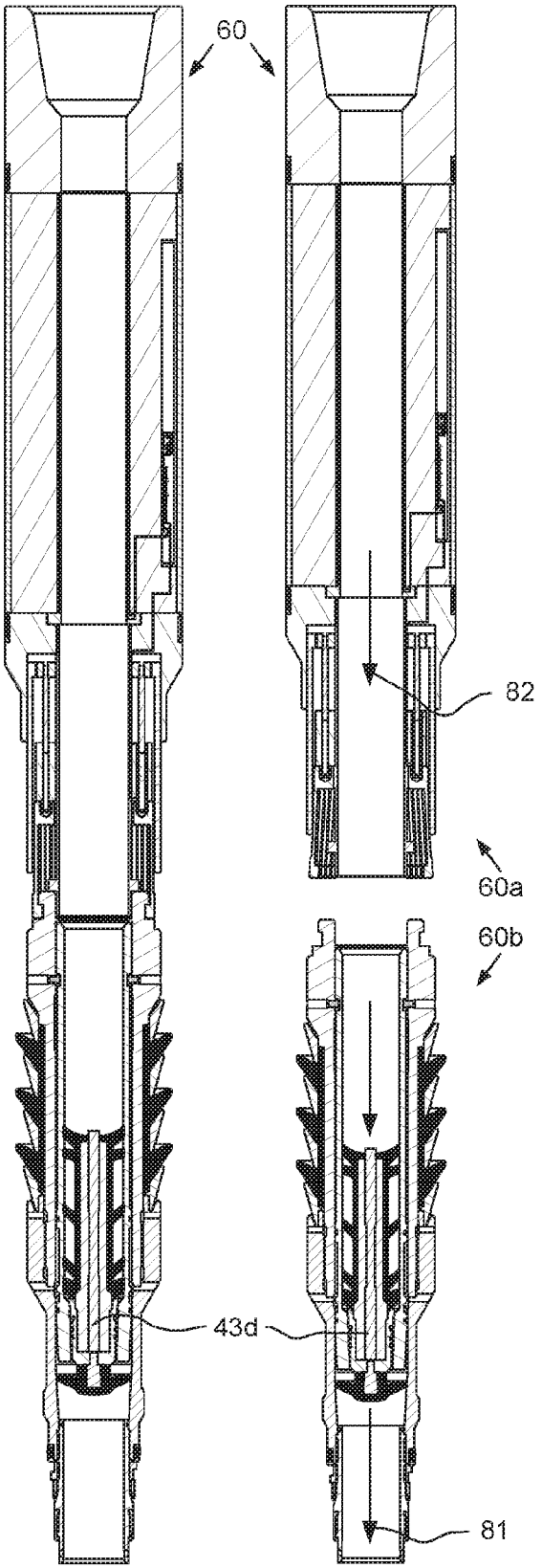

The lock sleeve 70 may have a threaded coupling formed at an upper end thereof for receiving a threaded coupling formed in an outer surface of the hub 69*h*, thereby connecting the lock sleeve and the hub. The lock sleeve 70 may be longitudinally movable by the actuator 69 and relative to the housing 61 between a lower position (shown) and an upper position (FIG. 4E). The lock sleeve 70 may be stopped in the lower position by engagement of a lower end thereof with a stop shoulder 72*h* of the wiper plug 60*b*.

The collet 71 may have an upper base portion and fingers extending from the base portion to a lower end thereof. The collet base may have a threaded socket formed in an upper end thereof for each actuator cylinder. A lower end of each actuator cylinder may be threaded and received in the respective socket, thereby connecting the solenoid 69*s* and guide 69*g* to the collet 71. The collet base may have a threaded inner surface for receiving a threaded outer surface of the retainer sleeve 67, thereby connecting the collet 71 and the housing 61. The retainer sleeve 67 may have a stop shoulder formed in an outer surface thereof for receiving an upper end of the wiper plug 60*b*.

The collet 71 may be radially movable between an engaged position (shown) and a disengaged position (FIG. 4F) by interaction with the lock sleeve 70. Each collet finger may have a lug formed at a lower end thereof. In the engaged position, the collet lugs may mate with a complementary groove 72*g* of the wiper plug 60*b*, thereby releasably connecting the wiper plug 60*b* to the housing 61. The collet fingers may be cantilevered from the collet base and have a stiffness urging the lugs toward the disengaged position. Downward movement of the lock sleeve 70 may press the collet lugs into the groove 72*g* against the stiffness of the collet fingers. Upward movement of the lock sleeve 70 may allow the stiffness of the collet fingers to pull the lugs from the groove 72*g*, thereby releasing the wiper plug 60*b* from the launcher 60*a*.

The wiper plug 60*b* may include a body 72, a mandrel 73, a stinger 74, a wiper seal 75, an anchor 76, and a seat 77. The body 72 may have the groove 72*g* formed in an inner surface thereof adjacent to an upper end thereof, the stop shoulder 72*h* formed in the inner surface thereof adjacent to the groove 72*g*, one or more threaded sockets 72*s* formed through a wall thereof, and a threaded coupling formed at a lower end thereof. Each of the body 72, mandrel 73, stinger 74, anchor 76, and seat 77 may be made from a drillable material, such as cast iron, nonferrous metal or alloy, fiber reinforced composite, or engineering polymer.

The mandrel 73 may be disposed in a bore of the body 72, have a groove 73*g* formed in an outer surface thereof, a landing profile 73*p* formed in the inner surface thereof adjacent to a lower end thereof, and an upper seal groove 73*u* and a lower seal groove 73*g*, each formed in an outer surface thereof and each carrying a seal. The landing profile 73*p* may have a landing shoulder, a latch profile, and a seal bore for receiving the dart 43*d* (FIG. 4D). The dart 43*d* may have a complementary landing shoulder, a fastener for engaging the latch profile, thereby connecting the dart and the wiper plug 60*b*, and a seal for engaging the seal bore. A threaded fastener 78*u* may be received in each threaded socket 72*s* and extend into the groove 73*g*, thereby connecting the mandrel 73 and the body 72. The threaded fasteners 78*u* may be shearable fasteners for serving as an override to release the wiper plug 60*b* in the event of malfunction of the electronics package 62 and/or the latch 66.

The stinger 74 may have an upper threaded coupling formed in an inner surface thereof engaged with the body threaded coupling, thereby connecting the stinger and the body 72. The body 72 may have a reduced outer diameter mid and lower portion to form recess for receiving the wiper seal 75. The wiper seal 75 may be connected to the body 71 by entrapment between a shoulder 72*h* formed in an outer surface of the body 72 and an upper end of the stinger 74. The wiper seal 75 may include a fin stack, a backup stack, and a lower end adapter. Each stack may include one or more (three shown) units, each unit having a backup ring and a seal ring molded onto the respective backup ring. Each seal ring may be directional and made from an elastomer or elastomeric copolymer. An outer diameter of each seal ring may correspond to an inner diameter of the liner joints 15*j*, such as being slightly greater than the inner diameter. Each seal ring may be oriented to sealingly engage the liner joint 15*j* in response to pressure above the seal ring being greater than pressure below the seal ring. Each backup ring and the adapter may be made from one of the drillable materials. The stinger upper end may have a groove for mating with a lower lip of the end adapter.

The anchor 76 may include a mandrel, a longitudinal coupling, a torsional coupling, and an external seal. The stinger 74 may have a lower threaded coupling formed in the inner surface thereof and an outer groove formed in a lower end thereof. The anchor mandrel may have a threaded coupling formed in an outer surface thereof engaged with the stinger threaded coupling, thereby connecting the stinger 74 and the anchor 76. The anchor mandrel may have a groove formed in an inner surface thereof for carrying a seal, thereby isolating an interface formed between the anchor mandrel and the stinger 74. The external seal may be disposed in the stinger outer groove. A retainer may have an outer portion extending into the stinger outer groove and an inner portion trapped between the stinger lower end and an upper end of the torsional coupling, thereby trapping the external seal in the stinger outer groove. The torsional coupling may be a nut having a threaded inner surface engaged with the anchor mandrel threaded coupling and having one or more helical vanes formed on an outer surface thereof. The anchor mandrel may have a conical taper formed in an outer surface thereof and the longitudinal coupling may be disposed between the torsion nut and the conical taper. The longitudinal coupling may be a split ring having teeth formed along an outer surface thereof and a conical taper formed in an inner surface thereof complementary to the mandrel taper.

The seat 77 may include an outer nose and an inner receiver connected together, such as by threaded couplings. The anchor mandrel may have one or more (two shown) holes formed through a wall thereof adjacent a lower end thereof. The nose may have one or more threaded sockets formed through a wall thereof and the receiver may have one or more corresponding holes formed in an outer surface thereof. A threaded, shearable fastener 78*b* may be received in each of the sockets and extend through the respective anchor mandrel hole and into the corresponding receiver hole, thereby releasably connecting the seat 77 to the anchor 76. The receiver may have a conical taper formed in an inner surface thereof for receiving the ball 43*b* (FIG. 4A).

FIGS. 4A-4F illustrate operation of the plug release system 60. Once the liner string 15 has been advanced into the wellbore 24 by the workstring 9 to a desired deployment depth and the cementing head 7 has been installed, conditioner 80 may be circulated by the cement pump 13 through the valve 41 to prepare for pumping of cement slurry 81. The ball launcher 7*b* may then be operated and the conditioner 80 may propel the ball 43*b* down the workstring 9 to the seat 77. Once the ball 43*b* lands in the seat 77, pumping may continue to increase pressure in the LDA bore/actuation chamber 59.

Once a first threshold pressure is reached, a piston of the liner hanger 15*h* may set slips thereof against the casing 25. Pumping of the conditioner 80 may continue until a second threshold pressure is reached and the running tool 53 is unlocked. Pumping may continue until a third threshold pressure is reached and the seat 77 is released from the wiper plug 60*b* by fracturing of the shearable fasteners 78*b*. The released seat 77 and ball 43*b* may then be driven by the conditioner 80 through the liner bore to a catcher (not shown) of the landing collar 15*c*. Weight may then be set down on the liner string 15 and the workstring 9 rotated, thereby releasing the liner string 15 from the setting tool 53. An upper portion of the workstring 9 may be raised and then lowered to confirm release of the running tool 53. The workstring 9 and liner string 15 may then be rotated 8 from surface by the top drive 5 and rotation may continue during the cementing operation. Cement slurry 81 may be pumped from the mixer 42 into the cementing swivel 7*c* via the valve 41 by the cement pump 13. The cement slurry 81 may flow into the launcher 7*d* and be diverted past the dart 43*d* via the diverter and bypass passages.

Just before the desired quantity of cement slurry 81 has been pumped, the tag launcher 44 may be operated to launch the RFID tag 45 into the cement slurry 81. Once the desired quantity of cement slurry 81 has been pumped, the cementing dart 43*d* may be released from the launcher 7*d* by operating the plug launcher actuator. Chaser fluid 82 may be pumped into the cementing swivel 7*c* via the valve 41 by the cement pump 13. The chaser fluid 82 may flow into the launcher 7*d* and be forced behind the dart 43*d* by closing of the bypass passages, thereby propelling the dart into the workstring bore. Pumping of the chaser fluid 82 by the cement pump 13 may continue until residual cement in the cement discharge conduit has been purged. Pumping of the chaser fluid 82 may then be transferred to the mud pump 34 by closing the valve 41 and opening the valve 6.

The dart 43*d*, cement slurry 81, and RFID tag 45 may be driven through the workstring bore by the chaser fluid 82 until the tag reaches the antenna 64. The tag 45 may transmit the command signal 49*c* to the antenna 64 as the tag passes thereby. The MCU may receive the command signal from the tag 45 and may wait for a preset period of time to allow the dart 43*d* to seat into the landing profile 73*p* and for the resulting increase in pressure to propagate to the pressure gauge 37*m* for confirmation of the dart landing. This preset period of time may be determined using the speed of sound through the chaser fluid 82 and the depth of the landing profile from the waterline 2*s* plus a margin for uncertainty. After the delay period has lapsed, the MCU may operate the actuator controller 62*m* to energize the solenoid 69*s*, thereby driving the lock sleeve 70 to the upper position and allowing the collet 71 to release the combined dart 43*d* and wiper plug 60*b*.

Once released, the combined dart and wiper plug 43*d*, 60*b* may be driven through the liner bore by the chaser fluid 82, thereby driving the cement slurry 81 through the landing collar 15*c* and reamer shoe 15*s* into the annulus 48. Pumping of the chaser fluid 82 may continue until the combined dart and plug 43*d*, 60 land on the collar 15*c*, thereby engaging the anchor 76 with the collar. Once the combined dart and plug 43*d*, 60 have landed, pumping of the chaser fluid 82 may be halted and the workstring upper portion raised until the setting tool 52 exits the PBR 15*r*. The workstring upper portion may then be lowered until the setting tool 52 lands onto a top of the PBR 15*r*. Weight may then be exerted on the PBR 15*r* to set the packer 15*p*. Once the packer 15*p* has been set, rotation 8 of the workstring 9 may be halted. The LDA 9*d* may then be raised from the liner string 15 and chaser fluid 82 circulated to wash away excess cement slurry 81. The workstring 9 may then be retrieved to the MODU 1*m*.

As discussed above, should malfunction of the plug release system 60 occur, pressure in the LDA bore may be increased by continued pumping of the chaser fluid 82 until a sufficient pressure is reached for fracturing of the fasteners 78*u*, thereby releasing the mandrel 73 (with seated dart 43*d*). An outer surface of the mandrel 73 may have a conical taper formed therein adjacent to the lower end of the mandrel. An inner surface of the stinger 74 may have a complementary conical taper formed therein adjacent to a lower end of the mandrel 73. The released mandrel 73 and dart 43*d* may travel downwardly until the conical tapers engage, thereby jarring the wiper plug 60*b* in an attempt to remedy the malfunction. The override release pressure may be set by configuration of the fasteners 78*u* to correspond to a design pressure of the weakest component of the LDA 9*d*.

Alternatively, one or more RFID tags may be embedded in the dart, such as in one or more of the seal fins, thereby obviating the need for the tag launcher 44. Alternatively, the electronics package may further include a pressure sensor in fluid communication with the launcher bore and the MCU may operate the solenoid once a predetermined pressure has been reached (after receiving the command signal). Alternatively, the electronics package may include a proximity sensor instead of the antenna and the dart may have targets embedded in the fin stack for detection thereof by the proximity sensor.

Additionally, the cementing head may further include a second dart and the plug release system may further include a second wiper plug. The second wiper plug may be released using the same launcher or the plug release system may include a second launcher for launching the second wiper plug. The second dart may be launched before pumping of the cement slurry. A second RFID tag may be launched just before the second dart, may be embedded in the second dart, or be embedded in the ball.

Figure 5:
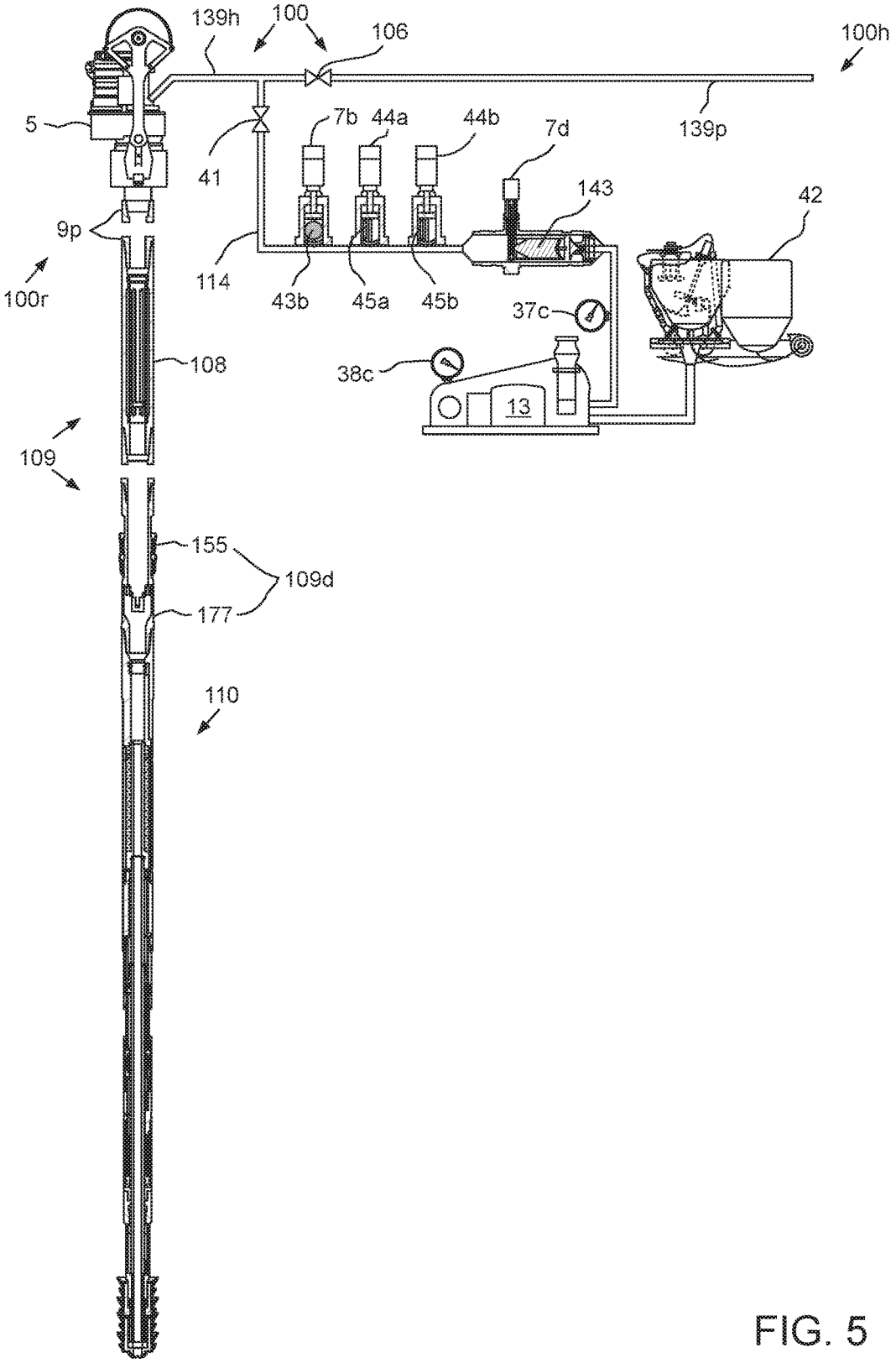
FIG. 5 illustrates an alternative drilling system, according to another embodiment of this disclosure.

FIG. 5 illustrates an alternative drilling system 100, according to another embodiment of this disclosure. The drilling system 100 may include the MODU 1*m*, a drilling rig 100*r*, a fluid handling system 100*h*, the fluid transport system it, the PCA 1*p*, and a workstring 109. The drilling rig 100*r* may include the derrick 3, the floor 4, the top drive 5, and the hoist. The fluid handling system 100*h* may include the cement pump 13, the mud pump 34, the tank 35, the shale shaker 36, the pressure gauges 37*c,m*, the stroke counters 38*c,m*, one or more flow lines, such as cement line 114; mud line 139*h,p*, and the return line 40, the cement mixer 42, the ball launcher 7*b*, the dart launcher 7*d*, and one or more tag launchers 44*a,b*.

The mud line 139*h,p* may include upper segment 139*h* and lower segment 139*p* connected by a flow tee also having an upper end of the cement line 114 connected thereto. A lower end of the lower mud line segment 139*p* may be connected to an outlet of the mud pump 34 and an upper end of the upper mud line segment 139*h* may be connected to the top drive inlet. The pressure gauge 37*m* and a shutoff valve 106 may be assembled as part of the lower mud line segment 139*p*. A lower end of the cement line 114 may be connected to an outlet of the cement pump 13. The ball launcher 7*b*, the dart launcher 7*d*, the tag launchers 44*a,b*, the shutoff valve 41, and the pressure gauge 37*c* may be assembled as part of the cement line 114.

The plug launcher 7*d* may have a pipeline pig 143 loaded therein instead of the dart 43*d*. The pig 143 may include a body, a tail plate. The body may be made from a flexible material, such as a foamed polymer. The foamed polymer may be polyurethane. The body may be bullet-shaped and include a nose portion, a tail portion and a cylindrical portion. The tail portion may be concave or flat. The nose portion may be conical, hemispherical or hemi-ellipsoidal. The tail plate may be bonded to the tail portion during molding of the body. The shape of the tail plate may correspond to the tail portion. The tail plate may be made from a (non-foamed) polymer, such as polyurethane.

An upper end of the workstring 109 may be connected to the top drive quill, such as by threaded couplings, during both deployment and cementation of the liner string 15. The workstring 109 may include a liner deployment assembly (LDA) 109*d* and the drill pipe string 9*p*. An upper end of the LDA 109*d* may be connected a lower end of the drill pipe 9*p*, such as by threaded couplings. The LDA 109*d* may also be connected to the liner string 15. The LDA 109*d* may include an upper catcher 108, the diverter valve 50, the junk bonnet 51, the setting tool 52, the running tool 53, the stinger 54, the (upper) packoff 55, the spacer 56, the release 57, a lower packoff 155, a lower catcher 177, and a plug release system 110.

An upper end of the upper catcher 108 may be connected to a lower end the drill pipe 9*p* and a lower end of the upper catcher 108 may be connected to an upper end of the diverter valve 50, such as by threaded couplings. An upper end of the lower packoff 155 may be connected to a lower end of the spacer 56, such as by threaded couplings. An upper end of the lower catcher 177 may be connected to a lower end of the lower packoff 155, such as by threaded couplings. An upper end of the plug release system 110 may be connected to a lower end of the lower catcher 177 such as by threaded couplings.

The upper catcher 108 may include a tubular housing, a tubular cage, and a baffle for receiving the pig 143. The housing may have threaded couplings formed at each longitudinal end thereof for connection with the drill pipe 9*p* at an upper end thereof and the diverter valve 50 at a lower end thereof. The catcher may have a longitudinal bore formed therethrough for passage of the ball 43*b* therethrough. The cage may be disposed within the housing and connected thereto, such as by being disposed between a lower housing shoulder and a threaded fastener connected to the housing. The cage may have solid top and bottom and a slotted body. The baffle may be fastened to the body. An annulus may be formed between the body and the housing. The annulus may serve as a bypass for the flow of fluid after the pig 143 is caught.

The lower packoff 155 may include a body and one or more (two shown) seal assemblies. The body may have threaded couplings formed at each longitudinal end thereof for connection to the spacer 56 at an upper end thereof and the lower catcher 177 at a lower end thereof. Each seal assembly may include a directional seal, such as cup seal, an inner seal, a gland, and a washer. The inner seal may be disposed in an interface formed between the cup seal and the body. The gland may be fastened to the body, such as a by a snap ring. The cup seal may be connected to the gland, such as molding or press fit. An outer diameter of the cup seal may correspond to an inner diameter of the liner hanger 15*h*, such as being slightly greater than the inner diameter. The cup seal may oriented to sealingly engage the liner hanger inner surface in response to pressure in the LDA bore being greater than pressure in the liner string bore (below the liner hanger).

The lower catcher 177 may include a body and a seat for receiving the ball 43*b* and fastened to the body, such as by one or more shearable fasteners. The seat may also be linked to the body by a cam and follower. Once the ball 43*b* is caught, the seat may be released from the body by a threshold pressure exerted on the ball. Once released, the seat and ball 43*b* may swing relative to the body into a capture chamber, thereby reopening the LDA bore.

Figures 6A, 6B, 6C:
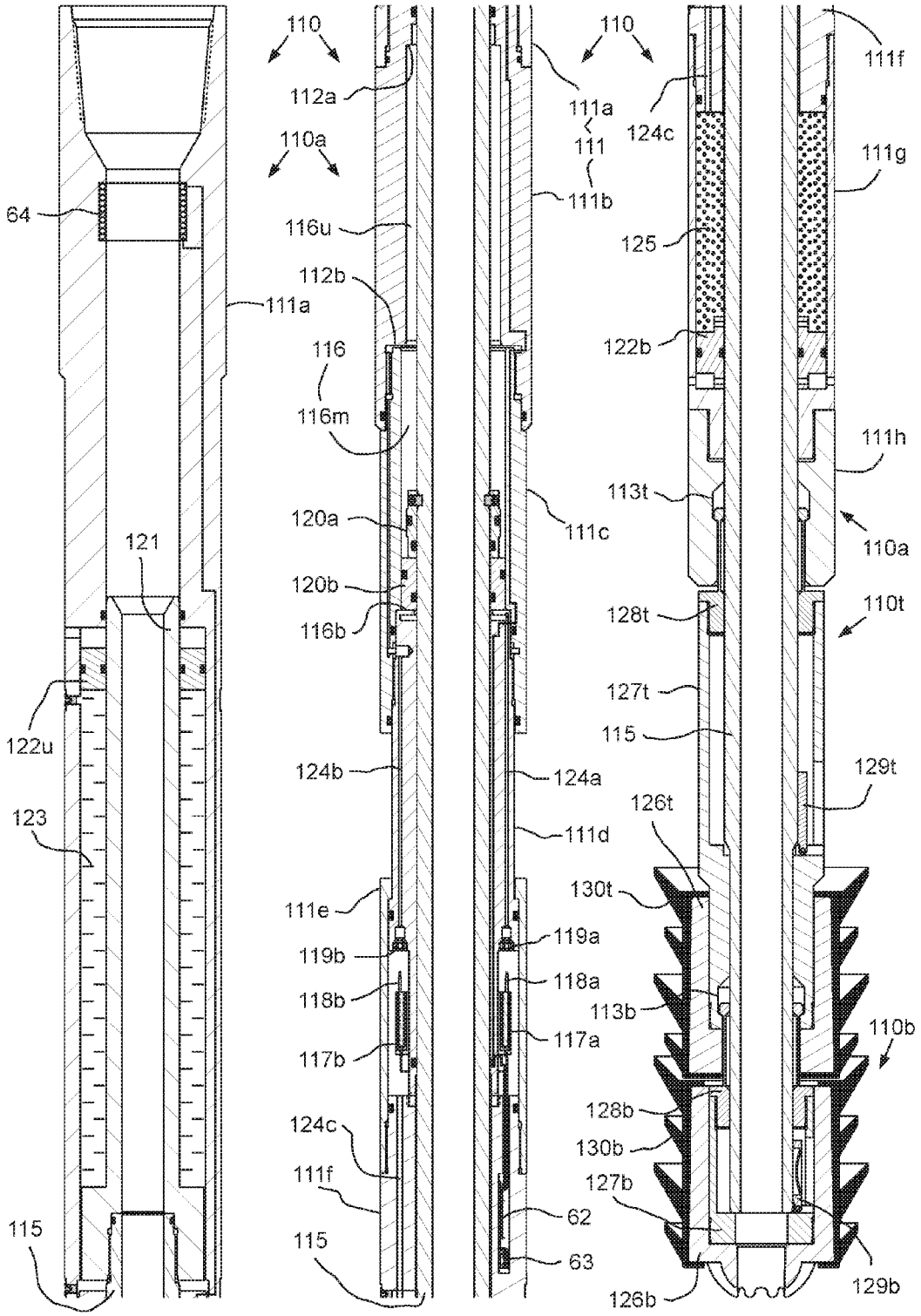
FIGS. 6A-6C illustrate a plug release system of the alternative drilling system.

FIGS. 6A-6C illustrate the plug release system 110. The plug release system 110 may include a launcher 110*a* and one or more cementing plugs, such as a top wiper plug 110*t* and a bottom wiper plug 110*b*. Each of the launcher 110*a* and each wiper plug 110*t,b* may be a tubular member having a bore formed therethrough. The launcher 110*a* may include a housing 111, the electronics package 62, the battery 63, the antenna 64, a mandrel 115, and an actuator.

The housing 111 may include two or more tubular sections 111*a-h*. The housing sections 111*a-c* and 111*f-h* may be connected to each other, such as by threaded couplings. Interfaces between the housing sections 111*a-h* may be isolated by seals. An upper end of the fourth housing section 111*d* may be connected to a lower end of the third housing section 111*c*, such as by threaded couplings. A lower end of the fifth housing section 111*e* may be connected to an upper end of the sixth housing section 111*f*, such as by threaded couplings. The fourth housing section 111*d* may have a shoulder formed in an outer surface thereof dividing the section into an enlarged outer diameter upper portion and a reduced outer diameter lower portion. The fifth housing section 111*e* may have a complementary shoulder formed in an inner surface thereof adjacent to an upper end thereof and may receive the reduced lower portion and the shoulder, thereby longitudinally connecting the fourth 111*d* and fifth housing sections. The fourth housing section 111*d* may also have a torsional coupling, such as a castellation, formed in a lower end thereof and the sixth housing section 111*f* may have a complementary castellation formed in an upper surface thereof and engaged with the castellation of the fourth housing section, thereby torsionally connecting the sections. The housing 111 may have a coupling, such as threaded coupling, formed at an upper end thereof for connection to the lower catcher 177. The housing 111 may have recesses formed therein for receiving the antenna 64, the electronics package 62, and the battery 63.

Figures 7A, 7B, 7C, 7D:
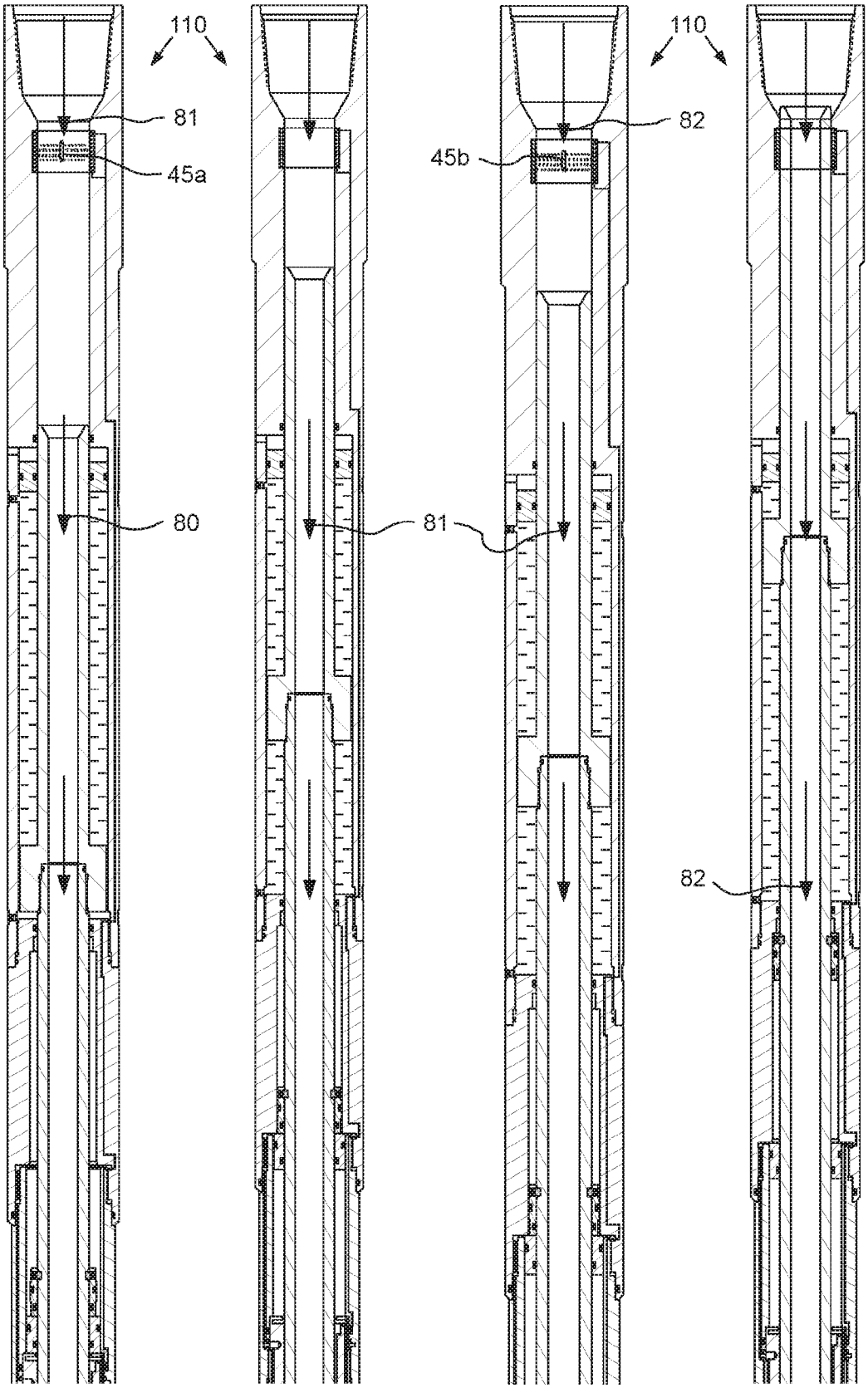
FIGS. 7A-7D illustrate operation of an upper portion of the alternative plug release system.
Figures 8A, 8B, 8C, 8D:
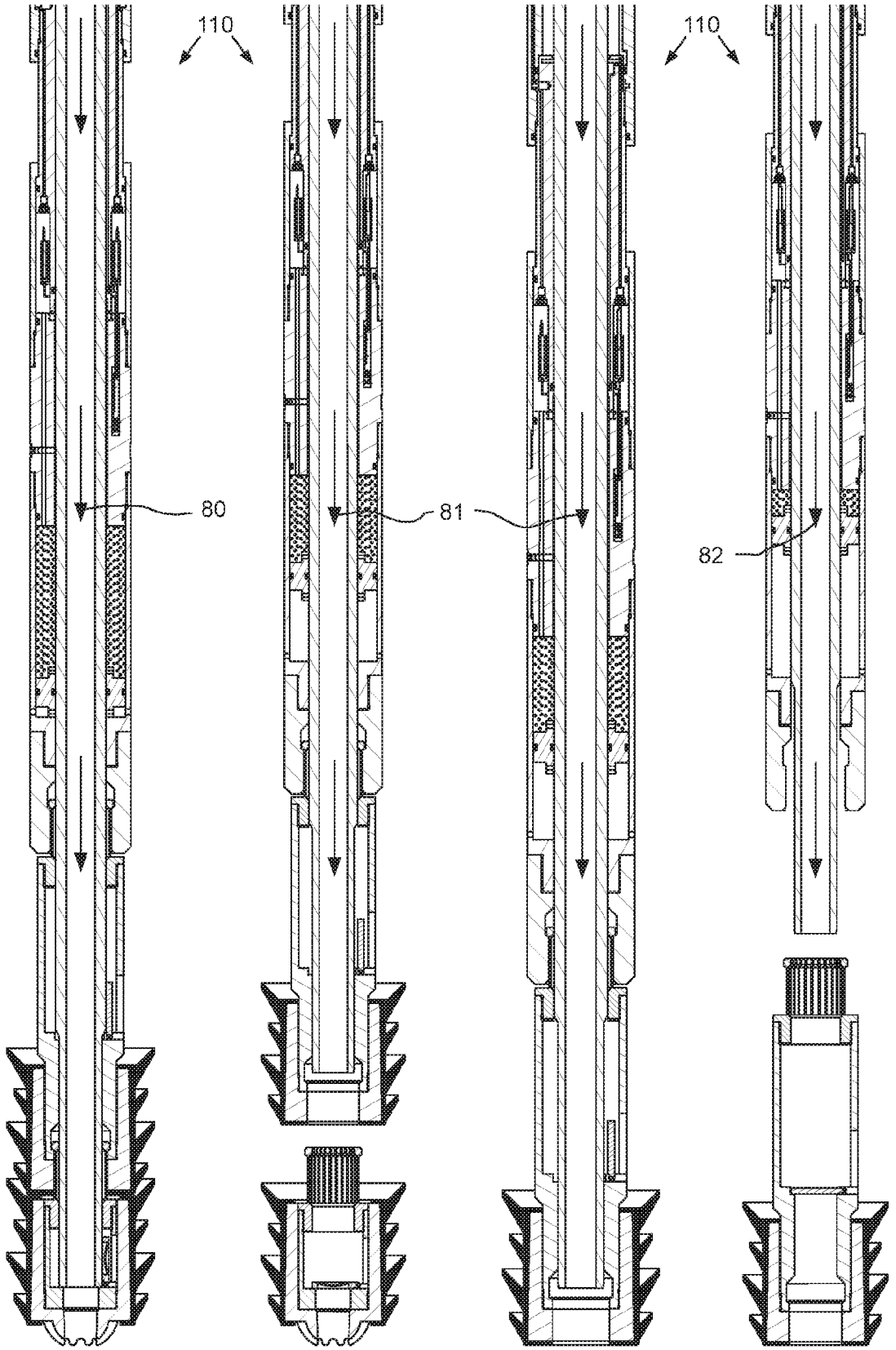
FIGS. 8A-8D illustrate operation of a lower portion of the alternative plug release system.

The mandrel 115 may be tubular and have a longitudinal bore formed therethrough. The mandrel 115 may be disposed in the housing 111 and longitudinally movable relative thereto from a locked position (shown) to a lower unlocked position (FIGS. 7B and 8B) and then to an upper unlocked position (FIGS. 7D and 8D). The mandrel 115 may be releasably connected to the housing 111 in the locked position, such as by one or more shearable fasteners (not shown).

The actuator may include a hydraulic chamber, a damper chamber, a damper piston 121, an atmospheric chamber 116, an actuation chamber, a first solenoid 117*a*, a first pick 118*a*, a second solenoid 117*b*, a second pick 118*b*, a first rupture disk 119*a*, and a second rupture disk 119*b*, an upper actuation piston 120*u*, a lower actuation piston 120*b*, and a gas chamber. A lower end of the damper piston 121 may be connected to an upper end of the mandrel 115, such as by threaded couplings. An interface between the damper piston 121 and the mandrel 115 may be isolated by a seal. The housing 111 may have electrical conduits formed in a wall thereof for receiving wires connecting the antenna 64 to the electronics package 62, connecting the battery 63 to the electronics package, and connecting the solenoids 117*a,b* to the electronics package.

The hydraulic, damper, atmospheric, and gas chambers may each be formed between the housing 111 and the damper piston 121 and/or mandrel 115. An upper balance piston 122*u* may be disposed in the hydraulic chamber and may divide the chamber into an upper portion and a lower portion. A port formed through a wall of the first housing section 111*a* may provide fluid communication between the hydraulic chamber upper portion and the annulus 48. The lower portion may be filled with a hydraulic fluid, such as oil 123. The hydraulic chamber may be in limited fluid communication with the damper chamber via a choke path formed between a shoulder of the damper piston 121 and the first housing section 111*a*. The choke path may dampen movement of the mandrel 115 to the other positions. A seal may be disposed in an interface between the first housing section 111*a* and the mandrel 115.

The atmospheric chamber 116 may be formed radially between the housing 111 and the mandrel 115 and longitudinally between a shoulder 112*a* formed in an inner surface of the second housing section 111*b* and an upper end of the fourth housing section 111*d*. A seal may be disposed in an interface between the shoulder 112*a* and the mandrel 115 and a seals may straddle an upper interface between the third and fourth housing sections 111*c,d*. The lower actuation piston 120*b* may be disposed in the atmospheric chamber 116 and may divide the chamber into a lower portion 116*b* and a mid portion 116*m*. The atmospheric chamber 116 may also have a reduced diameter upper portion 116*u* defined by another shoulder 112*b* formed in an inner surface of the second housing section 111*b*. The upper actuation piston 120*u* may have an outer diameter corresponding to the reduced diameter of the atmospheric chamber upper portion 116*u* and may carry a seal for engaging therewith. The upper actuation piston 120*u* may be connected to the mandrel 115, such as by threaded fasteners. The lower actuation piston 120*b* may be trapped between a lower end of the upper actuation piston 120*u* and the upper end of the fourth housing section 111*d* when the mandrel is in the locked position.

A first actuation passage 124*a* formed in the fourth housing section 111*d* may be in fluid communication with the actuation chamber and the atmospheric chamber lower portion 116*b*. The first rupture disk 119*a* may be disposed in the first actuation passage 124*a*, thereby closing the passage. A second actuation passage 124*b* formed in the third 111*c* and fourth 111*d* housing sections may be in fluid communication with the actuation chamber and the atmospheric chamber mid portion 116*m*. The second rupture disk 119*b* may be disposed in the second actuation passage 124*b*, thereby closing the passage.

The solenoids 117*a,b* and the picks 118*a,b* may be disposed in the actuation chamber. A gas passage 124*c* formed in the sixth housing section 111*f* may provide fluid communication between the gas chamber and the actuation chamber. A seal may be disposed in an interface between the fourth housing section 111*d* and the mandrel 115. A lower balance piston 122*b* may be disposed in the gas chamber and may divide the chamber into an upper portion and a lower portion. A port formed through a wall of the seventh housing section 111*g* may provide fluid communication between the gas chamber lower portion and the annulus 48. The upper portion may be filled with an inert gas, such as nitrogen 125. The nitrogen 125 may be compressed to serve as a fluid energy source for the actuator.

Each wiper plug 110*t,b* may include a respective body 126*t,b*, a mandrel 127*t,b*, a fastener, such as a collet 128*t,b*, a launch valve 129*t,b*, and a wiper seal 130*t,b*. Each body 126*t,b*, mandrel 128*t,b*, and launch valve 129*t,b*, may be made from one of the drillable materials. Each plug body 126*t,b* may be connected to a respective plug mandrel 128*t,b*, such as by threaded couplings.

Each wiper seal 130*t,b* may be connected to the respective plug body 126*t,b*, such as by being molded thereon. Each wiper seal 130*t,b* may include a plurality of directional fins and be made from an elastomer or elastomeric copolymer. An outer diameter of each fin may correspond to an inner diameter of the casing 25, such as being slightly greater than the casing inner diameter. Each wiper seal 130*t,b* may be oriented to sealingly engage the casing 25 in response to annulus pressure above the wiper seal being greater than annulus pressure below the wiper seal.

Each launch valve 129*t,b* may include a portion of the respective plug mandrel 127*t,b* forming a valve body and a valve member, such as a flapper, pivotally connected to the valve body and biased toward a closed position, such as by a torsion spring. Each flapper may be positioned above the respective valve body to serve as a piston in the closed position for releasing and driving the respective plug 110*t,b*. In the locked position, the launcher mandrel 115 may extend through the top plug 110*t* and into the bottom plug 110*b*, thereby propping the flappers open. The top flapper may be solid and the bottom flapper may have a bore formed therethrough closed by a rupture disk.

Each collet 128*t,b* may have a lower base portion and fingers extending from the base portion to an upper end thereof. Each collet base may be connected to an upper end of the respective plug mandrel 127*t,b*, such as by threaded couplings. Each collet 128*t,b* may be radially movable between an engaged position (shown) and a disengaged position by interaction with the launcher mandrel 115. Each collet finger may have a lug formed at an upper end thereof. In the engaged position, the top collet lugs may mate with a complementary groove 113*t* formed in an inner surface of the seventh housing section 111*h*, thereby releasably connecting the top plug 110*t* to the housing 111. In the engaged position, the bottom collet lugs may mate with a complementary groove 113*b* formed in an inner surface of the top plug mandrel 127*t*, thereby releasably connecting the bottom plug 110*b* to the top plug 110*t*.

The fingers of each collet 128*t,b* may be cantilevered from the collet base and have a stiffness urging the lugs toward the engaged position. The lugs of each collet 128*t,b* may be chamfered to interact with a chamfer of the respective groove 113*t,b* to radially push the respective fingers to the disengaged position in response to downward force exerted on the respective plug mandrel 12*pt,b* by fluid pressure after closing of the respective flappers. An outer diameter of the launcher mandrel 115 may correspond to an inner diameter of the lugs of each collet 128*t,b* in the engaged position, thereby preventing retraction of the fingers of each collet.

The bottom plug body 126*b* may have a torsional coupling formed in a lower end thereof. The torsional coupling may be an auto-orienting castellation for mating with a complementary profile of the float collar 15*c*.

Alternatively, the seventh housing section 111*h* may be longitudinally connected to the sixth housing section 111*g* and free to rotate relative thereto so that the wiper plugs are not rotated relative to the liner string during connection of the liner deployment assembly. Alternatively, the top plug body may have the torsional coupling formed in a lower end thereof and the bottom plug body may have the torsional coupling formed in an upper end thereof. Alternatively, the balance piston 122*u* and oil 123 may be omitted and the nitrogen 125 used to dampen movement and drive the actuating pistons 120*u,b*. Alternatively, the balance piston 122*b* and the nitrogen 125 may be omitted and hydrostatic head in the annulus 48 used to drive the actuating pistons. Alternatively, the balance piston 122*b* and the nitrogen 125 may be omitted and the oil 123 used to dampen movement and drive the actuating pistons. Alternatively, a fuse plug and heating element may be used to close each actuation passage and the respective passage may be opened by operating the heating element to melt the fuse plug. Alternatively, a solenoid actuated valve may be used to close each actuation passage and the respective passage may be opened by operating the solenoid valve actuator.

FIGS. 7A-7D illustrate operation of an upper portion of the plug release system 110. FIGS. 8A-8D illustrate operation of a lower portion of the plug release system 110. Once the liner string 15 has been advanced into the wellbore 24 by the workstring 109 to a desired deployment depth, the conditioner 80 may be circulated by the cement pump 13 through the open valve 41 (valve 106 closed), top drive 5, workstring 109, and liner string 15 to prepare for pumping of cement slurry 81. The ball launcher 7*b* may then be operated and the conditioner 80 may propel the ball 43*b* through the top drive 5 and down the workstring 9 to the lower catcher 177. Once the ball 43*b* lands in the catcher seat, pumping may continue to increase pressure in the LDA bore/actuation chamber 59.

Once a first threshold pressure is reached, a piston of the liner hanger 15*h* may set slips thereof against the casing 25. Pumping of the conditioner 80 may continue until a second threshold pressure is reached and the running tool 53 is unlocked. Pumping may continue until a third threshold pressure is reached and the catcher seat is released from the catcher body. Weight may then be set down on the liner string 15 and the workstring 109 rotated, thereby releasing the liner string 15 from the setting tool 53. An upper portion of the workstring 109 may be raised and then lowered to confirm release of the running tool 53. The workstring 109 and liner string 15 may then be rotated 8 from surface by the top drive 5 and rotation may continue during the cementing operation. The first tag launcher 44*a* may then be operated to launch the first RFID tag 45*a* into the conditioner 80. The cement slurry 81 may then be pumped from the mixer 42, through the cement line 114, valve 41, upper mud line segment 139*h*, and top drive 5 into the workstring 109 by the cement pump 13.

Just before the desired quantity of cement slurry 81 has been pumped, the second tag launcher 44*b* may be operated to launch the second RFID tag 45*b* into the cement slurry 81. Once the desired quantity of cement slurry 81 has been pumped, the pig 143 may be released from the launcher 7*d* by operating the plug launcher actuator. Chaser fluid 82 may be pumped by the cement pump 13 to propel the pig 143 through the top drive 5 and into the workstring 109. Pumping of the chaser fluid 82 may then be transferred to the mud pump 34 by closing the valve 41 and opening the valve 106.

The pig 143, cement slurry 81, and RFID tags 45*a,b* may be driven through the workstring bore by the chaser fluid 82 until the first tag 45*a* reaches the antenna 64. The first tag 45*a* may transmit a first command signal to the antenna 64 as the tag passes thereby. The MCU may receive the first command signal from the first tag 45*a* and may operate the actuator controller 62*m* to energize the first solenoid 117*a*, thereby driving the first pick 118*a* into the first rupture disk 119*a*. Once the first rupture disk 119*a* has been punched, the nitrogen 125 from the gas chamber may drive the lower actuation piston 120*b* upward toward the housing shoulder 112*b*. The lower actuation piston 120*b* may push the upper actuation piston 120*u* and launcher mandrel 115 upward into the atmospheric chamber mid portion 116*b*. Once the upward stroke has finished by the lower actuation piston 120*b* seating against the housing shoulder 112*b*, the launcher mandrel 115 may be clear of the bottom launch valve 129*b* and bottom collet 128*b*. The bottom flapper may close and pressure may increase thereon until the bottom plug 110*b* is released from the top plug 110*t*.

The released bottom plug 110*b* may then be propelled through the liner string 15 by the fluid train. The pig 143 may land in the upper catcher 108 and the bottom plug may encounter the landing collar 15*c*. Continued pumping of the chaser fluid 82 may exert pressure on the landed bottom plug 110*b* until the rupture disk thereof bursts, thereby opening the bore of the bottom flapper so that the cement slurry 81 may flow through the bore and into the annulus 48. Contemporaneously, the second tag 45*b* may reach the antenna 64 and transmit a second command signal to the antenna 64 as the tag passes thereby.

The MCU may receive the second command signal from the second tag 45*b* and may energize the second solenoid 117*b*, thereby driving the second pick 118*b* into the second rupture disk 119*b*. Once the second rupture disk 119*b* has been punched, the nitrogen 125 from the gas chamber may drive the upper actuation piston 120*u* upward toward the shoulder 112*a*. Once the upward stroke has finished, the launcher mandrel 115 may be clear of the top launch valve 129*u* and top collet 128*u*. The top flapper may close and pressure may increase thereon until the top plug 110*u* is released from the seventh housing section 111*h*.

Once released, the top plug 110*t* may be driven through the liner bore by the chaser fluid 82, thereby driving the cement slurry 81 through the landing collar 15*c* and reamer shoe 15*s* into the annulus 48. Pumping of the chaser fluid 82 may continue until the top plug 110*t* lands onto the bottom plug 110*b* at the float collar 15*c*. Once the top plug 110*t* has landed, pumping of the chaser fluid 82 may be halted and the workstring upper portion raised until the setting tool 52 exits the PBR 15*r*. The workstring upper portion may then be lowered until the setting tool 52 lands onto a top of the PBR 15*r*. Weight may then be exerted on the PBR 15*r* to set the packer 15*p*. Once the packer has been set, rotation 8 of the workstring 109 may be halted. The LDA 109*d* may then be raised from the liner string 15 and chaser fluid 82 circulated to wash away excess cement slurry 81. The workstring 9 may then be retrieved to the MODU 1*m*.

Alternatively, the pig may be omitted and the chaser fluid pumped directly behind the cement slurry or a gel plug used instead of the pig. Alternatively, the bottom plug may be omitted. Alternatively, one or more RFID tags may be embedded in the pig, such as in the tail, thereby obviating the need for the second tag launcher 44. Alternatively, the first and second tags may have identical command signals and the MCU may ignore command signals for a predetermined period of time after receiving the first command signal. Alternatively, the electronics package may include a proximity sensor instead of the antenna and the dart may have targets embedded in the fin stack for detection thereof by the proximity sensor.

Alternatively, either plug release system 60, 110 may be used for deploying a casing string instead of deploying the liner string 15. Alternatively, an expandable liner hanger may be used instead of the liner hanger and packer.

While the foregoing is directed to embodiments of the present disclosure, other and further embodiments of the disclosure may be devised without departing from the basic scope thereof, and the scope of the invention is determined by the claims that follow.

The invention claimed is:

1. A system comprising:

a tubular string having a plug release mechanism fixed at a lower end, wherein, when the tubular string is installed in a wellbore, the lower end is remote from a surface of the wellbore, the plug release mechanism comprising:

a launcher; and a releasable plug releasably attached to the launcher;

a wireless identification tag; and wherein the launcher is configured to release the releasable plug in response to a wireless signal from the wireless identification tag.

2. The system of claim 1, wherein the releasable plug is a cementing plug.

3. The system of claim 1, wherein the wireless identification tag is a radio frequency identification tag.

4. The system of claim 1, wherein the wireless identification tag is embedded in a dart or a pig.

5. The system of claim 1, further comprising a liner and a liner setting tool, wherein the liner setting tool is configured to set the liner at the lower end of the tubular string in response to the release of the releasable plug.

6. A method comprising:

providing a tubular string in a wellbore, the tubular string having a plug release mechanism fixed at a lower end that is remote from a surface of the wellbore, the plug release mechanism comprising:

a launcher; and a plug releasably attached to the launcher;

providing a wireless identification tag that travels from the surface of the wellbore to the lower end of the tubular string; and releasing the plug from the launcher in response to a wireless signal from the wireless identification tag.

7. The method of claim 6, wherein the plug is a cementing plug.

8. The method of claim 6, wherein the wireless identification tag is a radio frequency identification tag.

9. The method of claim 6, wherein the wireless identification tag is embedded in a dart or a pig.

10. The method of claim 6, further comprising setting a liner at the lower end of the tubular string with a liner setting tool in response to the releasing the plug.

11. A method, comprising:

causing a wireless identification tag to be launched into a cement slurry, wherein the cement slurry is pumped into a deployment string in a wellbore; and sending a command signal from the wireless identification tag to a plug release system of a deployment assembly of the deployment string, the plug release system comprising:

a launcher; and a cementing plug releasably attached to the launcher.

12. The method of claim 11, wherein the cement slurry is driven through the deployment string while the command signal is sent.

13. The method of claim 12, wherein the cementing plug is a wiper plug, and further comprising causing the wiper plug to be released from the launcher in response to the command signal.

14. The method of claim 13, wherein:

the cement slurry is driven by pumping a release plug behind the cement slurry, the release plug engages the wiper plug, and the launcher releases the wiper plug after engagement of the release plug with the wiper plug.

15. The method of claim 14, wherein the wireless identification tag is embedded in the release plug.

16. The method of claim 14, wherein the engaged release plug and wiper plug drive the cement slurry through an inner tubular string and into an annulus formed between the inner tubular string and the wellbore.

17. The method of claim 12, wherein the cement slurry is driven by pumping a pig behind the cement slurry.

18. The method of claim 11, wherein:

an upper end of the deployment string is connected to a top drive, and the cement slurry is pumped through the top drive.

19. The method of claim 11, further comprising causing a hanger of an inner tubular string to be set before the cement slurry is pumped.

20. The method of claim 19, wherein the hanger is set by:

pumping a setting plug down the deployment string to a seat of the plug release system, and pressurizing a chamber formed between a packoff of the deployment assembly and the cementing plug, wherein the cementing plug is a wiper plug.

21. The method of claim 19, further comprising causing a packer of the inner tubular string to be set after the cement slurry is pumped.

* * * * *